United States Patent [19]

Stephens

[11] Patent Number: 4,588,987

[45] Date of Patent: May 13, 1986

[54] DISPLAY SYSTEM FOR MONITORING AND ALARM SYSTEM

[75] Inventor: Lawrence K. Stephens, Dallas, Tex.

[73] Assignee: International Business Machines Corp., Armonk, N.Y.

[21] Appl. No.: 531,774

[22] Filed: Sep. 13, 1983

[51] Int. Cl.[4] ..... G08B 25/00

[52] U.S. Cl. ..... 340/525; 340/505; 340/511; 340/286 M; 340/715

[58] Field of Search ..... 340/525, 500, 505, 506, 340/511, 518, 524, 531, 825.06, 725.07, 825.08–825.13, 825.36, 825.52, 825.54, 825.55, 286 M, 286 R, 747, 705, 715, 755, 990, 995; 364/188, 189

[56] References Cited

U.S. PATENT DOCUMENTS

| | | | |
|---|---|---|---|
| 3,387,084 | 6/1968 | Hine et al. | 340/705 |
| 3,754,244 | 8/1973 | Garrett | 340/286 M |
| 4,303,973 | 12/1981 | Williamson, Jr. et al. | 340/712 |
| 4,381,505 | 4/1983 | Dion | 340/286 R |
| 4,390,872 | 6/1983 | Murakami et al. | 340/715 |
| 4,435,779 | 3/1984 | Mayer et al. | 340/747 |

FOREIGN PATENT DOCUMENTS 2087610 5/1982 United Kingdom .

OTHER PUBLICATIONS

"IEEE Transactions on Nuclear Science", IEEE, vol. NS 29; Feb. 1982, No. 1, pp. 869–873.

*Primary Examiner*—Donnie L. Crosland

*Attorney, Agent, or Firm*—C. Lamont Whitham; James H. Barksdale; John L. Jackson

[57] ABSTRACT

A display system is provided for a monitoring and alarm system. The monitoring and alarm system includes a central processing unit (10) and a plurality of sensors (14) polled by the central processing unit. A display which is part of the central processing unit is used to prompt user inputs to group a plurality of the sensed variables and the states and limits of each of the variables in a group. The display system is employed by the user to generate a schematic display of the system or environment being monitored. In the process of generating the schematic display, the user links alarm areas on the schematic display with a group or single variable defined by the user. In addition, the user links message areas on the schematic display with user defined messages to be displayed in the event all the conditions defined by the states and limits of variables in a group are true. After each schematic has been generated, it is stored together with the data defining the linked areas of the display. A stored schematic display may then be invoked, and once invoked, messages and status conditions are displayed in response to the sensed conditions of groups of variables sensed by said monitoring and alarm system.

10 Claims, 9 Drawing Figures

DISPLAY SYSTEM FOR MONITORING AND ALARM SYSTEM

CROSS REFERENCE TO RELATED APPLICATIONS present application describes an improvement to the invention disclosed in application Ser. No. 06/531,650, filed concurrently herewith by Lawrence Keith Stephens and Robert B. Hayes entitled "Monitoring and Alarm System for Custom Applications". The invention described in this application uses a schematic display generator which is the subject of application Ser. No. 06/499,458 filed May 31, 1983, entitled "Schematic Building Cursor Character", a text placement scheme for graphics displays which is the subject of application Ser. No. 06/499,451 filed May 31, 1983, entitled "Text Placement on Graphics Screen", and a graphics box generator that is described in application Ser. No. 06/531,651, filed concurrently herewith, all of which applications were filed by Lawrence Keith Stephens and assigned to a common assignee with this application.

FIELD OF THE INVENTION

The present invention is in the field of monitoring and alarm systems, and more particularly, the invention is directed to a display system which facilitates customization and use of a general purpose monitoring and alarm system to a variety of applications and environments.

BACKGROUND OF THE INVENTION

Monitoring and alarm systems are required for a wide variety of applications ranging from simple mechanisms to rather complex processes. An example of a simple mechanism requiring a monitoring and alarm system would be a home heating system, and an example of a complex process also requiring a monitoring and alarm system would be a petroleum cracking plant. In the past, the monitoring and alarm systems that have been provided for such diverse applications have been quite different reflecting the differing complexity of the applications. For example, a heating system might be equipped with a temperature sensor to monitor the plenum temperature of the furnace and a simple audio or visual alarm to provide an indication when a safe temperature is exceeded. In contrast, the petroleum cracking plant incorporates many processes that are mutually interdependent. Not only are temperatures at various points in the plant monitored, but flow rates, chemical constituents and various other variables are monitored. Some of the monitored variables may have single valued limits which, if exceeded, would constitute an alarm condition. More often, however, the variables being monitored are interdependent meaning that an alarm condition is not indicated unless a certain combination of variable values is detected.

The monitoring and alarm systems which have been developed for very complex applications are characterized by central processing units (CPU) connected to receive inputs from a plurality of sensors and to generate the appropriate alarms or other indications that may be required for the particular application. The CPU is programmed and otherwise adapted for use in the specific environment. Since each installation is, in effect, a special purpose design, the monitoring and alarm systems for such complex applications are very expensive; however, the expense is justified by the relatively great cost of the application itself. There are on the other hand many applications which would be greatly improved by more sophisticated monitoring and alarm systems but for which the expense of such systems as presently designed cannot be justified.

In the aforementioned related application Ser. No. 06/531,650, there is described a monitoring and alarm system of general purpose design which can be customized for use with many different applications to provide sophisticated alarming functions based on logical relationships among several sensed variables. In that system, the end user inputs the desired states, limits and logical relationships for several sensed variables for a particular application. The user does this in response to prompts provided in the form of screens or menus displayed by the monitor of a microcomputer. The present invention is an extension or improvement of that basic monitoring and alarm system which allows the end user to generate and display schematic representations of the application or environment showing the locations of the various sensors and other components. The displayed schematic representation is linked with the logical groups and alarm conditions to provide the user of the monitoring and alarm system with the maximum possible information about the monitored application.

SUMMARY OF THE INVENTION

It is therefore an object of the present invention to provide a display system for a monitoring and alarm system which allows the end user to generate and display schematic representations of monitored application or environment.

It is a further object of the subject invention to provide an interactive display system that displays a schematic representation of a monitored application or environment in which the end user links logical groups and/or single variables to positions on the schematic display.

It is yet another object of the invention to provide a monitoring and alarm system adapted for custom applications with an interactive display that allows the end user to link areas of a graphic display to alarm situations and value areas.

The foregoing and other objects of the invention are attained by the linking of dynamic data and alarm areas during schematic generation. Variables or alarm/action definitions are linked to areas on a schematic of the system being monitored and this causes values, states or messages to be displayed on the screen or blink an area on the screen to show an alarm situation. A schematic of the environment or system being monitored is constructed using an interactive display. This is accomplished using the schematic display generator described in application Ser. No. 06/499,458 and the text placement scheme for graphics displays described in application Ser. No. 06/499,451. A logical group or variable name is then linked to a position on the screen by moving a cursor to starting coordinates on the display screen. A rectangular box with one corner at the starting coordinates is then generated to enclose the logical group or variable. The generated box represents an alarm window. An alarm/action is then linked to the logical group or variable enclosed in the box. This process is repeated until all logical groups and single variables have been linked to an alarm/action function. When this process has been completed, the display is stored.

Once the dynamic display has been generated, it is invoked from a menu selection on the display directory screen. For any given environment or system being monitored, there will typically be a plurality of dynamic displays. Most environments or systems that will be monitored will be too complex to permit the generation of a schematic display that can be accomodated on a single CRT screen. Therefore, the environment or system will be divided into a plurality of sections, and schematics generated for each section. Even for simple environments or systems, a plurality of displays may be generated to show specific components in the system in greater detail. The name selected from the display directory is passed to the dynamic display and employed to determine which dynamic display table and background is to be employed. The dynamic display creates an in-memory data base of variables, alarm/action entries and dynamic display entries. This data base is used to get alarm messages, blink locations on the screen, determine if alarm/action entries are active and write out history entries. The in-memory data base for variables consists of one multi-entry variable array with "analog ins" at one end and "digital ins" and "digital outs" mixed with timer variables at the other end. As defined in the aforementioned related application, Ser. No. 06/531,650, entitled "Monitoring and Alarm System for Custom Applications", an "analog in" is an input signal from a sensor that produces a signal that may vary over a range of values. For example, an "analog in" might be generated by a thermocouple and represent a temperature range of $-120°$ to $+120°$ Fahrenheit. In contrast a "digital in" signal would have either an on or off value. Similarly, a "digital out" signal may be turned on or off by a software transaction initiated at the host computer. In addition, there are "timer" signals which are input by the user to define a delay, if any, for the alarm/action function. When the desired dynamic display is invoked, sensors are monitored to acquire data and the data is checked against limits and statuses which were previously input by the user. Then the coniditions of defined logical groups are checked, and alarm/action signals are generated and messages displayed as required.

BRIEF DESCRIPTION OF THE DRAWINGS

The foregoing and other objects, advantages and aspects of the invention will be understood from the following detailed description with reference to the accompanying drawings, in which.

DETAILED DESCRIPTION OF THE INVENTION

Figure 1:
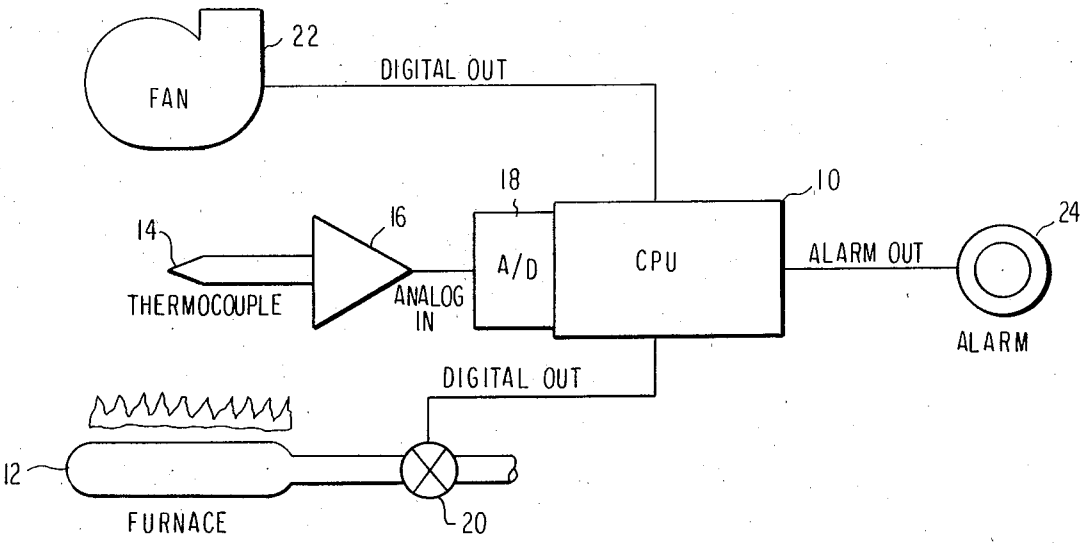
FIG. 1 is a block diagram of a simple furnace control system used as a pedagogical example of the operation of the invention.

Referring now to the drawings and more particularly to FIG. 1, there is shown a simple furnace control system which illustrates the basic principles of the subject invention. A host computer 10 is the principle monitoring and control element. In the preferred embodiment, the host computer 10 is an IBM Personal Computer or similar microcomputer, and as more particularly described in the copending application Ser. No. 06/531,650, entitled "Monitoring and Alarm System for Custom Applications", the host computer 10 is programmed to permit the user to customize the monitoring and control functions of the computer for the specific applications and environment. In this simple example, a furnace burner 12 is operational to gernerate heat, and a thermocouple 14 is responsive to the heat generated and produces an electrical signal which is amplified by amplifier 16. The output of amplifier 16 is connected to one input of the host computer 10 by means of an appropriate analog-to-digital interface 18. The signal from the amplifier 16 is referred to as an "analog in" signal as previously defined. There are three "digital out" signals from the host computer 10. One is supplied to a valve 20 that is operative to turn the burner 12 either on or off. A second is supplied to the fan 22 to turn it either on or off. The third is supplied to the alarm 24 to activate it.

In the invention described in application Ser. No. 06/531,650, entitled "Monitoring and Alarm System for Custom Applications", the first operation that must be performed by the user is to define the variables of the system that is being monitored and controlled. This process may be characterized as creating a strategy of control and is accomplished by associating variable names with sensor hardware addresses. This is facilitated with a series of screens or menus. The next step in defining the control strategy employed is to create the logical groupings of the defined variables. This is also facilited with a series of screens or menus to first provide a name for the logical group, then define the logical group and the limits and status of the individual members of the group, and finally define the "digital out" signals and input the user defined messages to appear when all of the values of the logical group are true.

The present invention provides a dynamic display for the monitoring and alarm system which provides especially useful information to the system operator. This display is a schematic representation of the environment or system being monitored and provides a dynamic indication to the system operator of the status and values of the various variables being monitored, the status of the "digital out" signals, and an alarm condition, if any, plus any predefined messages as may be required by the conditions detected. The first step is the generation of the schematic and the linking of dynamic data and alarm areas in the display during the schematic generation. Reference may be made to applications Ser. No. 06/499,458 and Ser. No. 06/499,451, both filed May 31, 1983 by Lawrence Keith Stephens for details of generating the schematic display.

Figure 2:
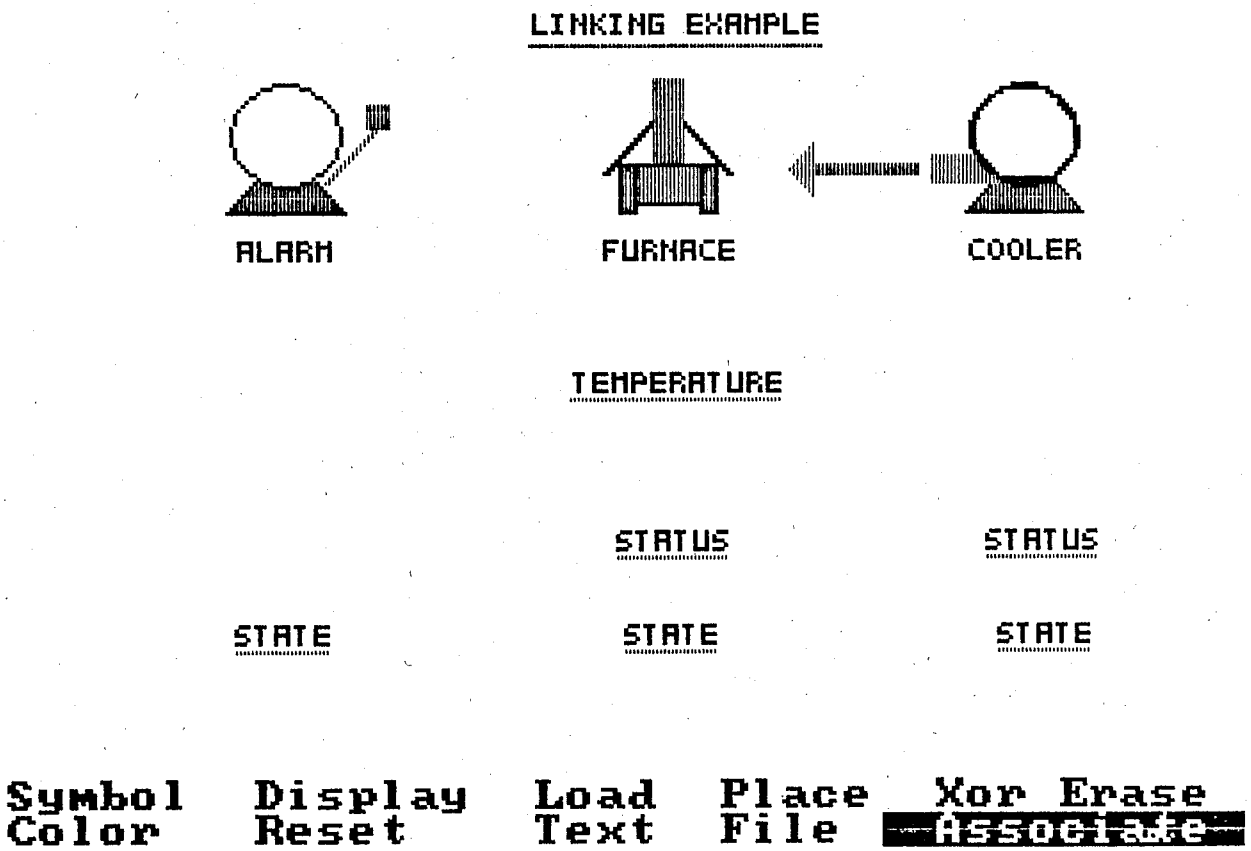
FIGS. 2 to 6 are illustrations of a schematic display for the pedagogical example of FIG. 1 showing the process of linking according to the subject invention.
Figure 3:
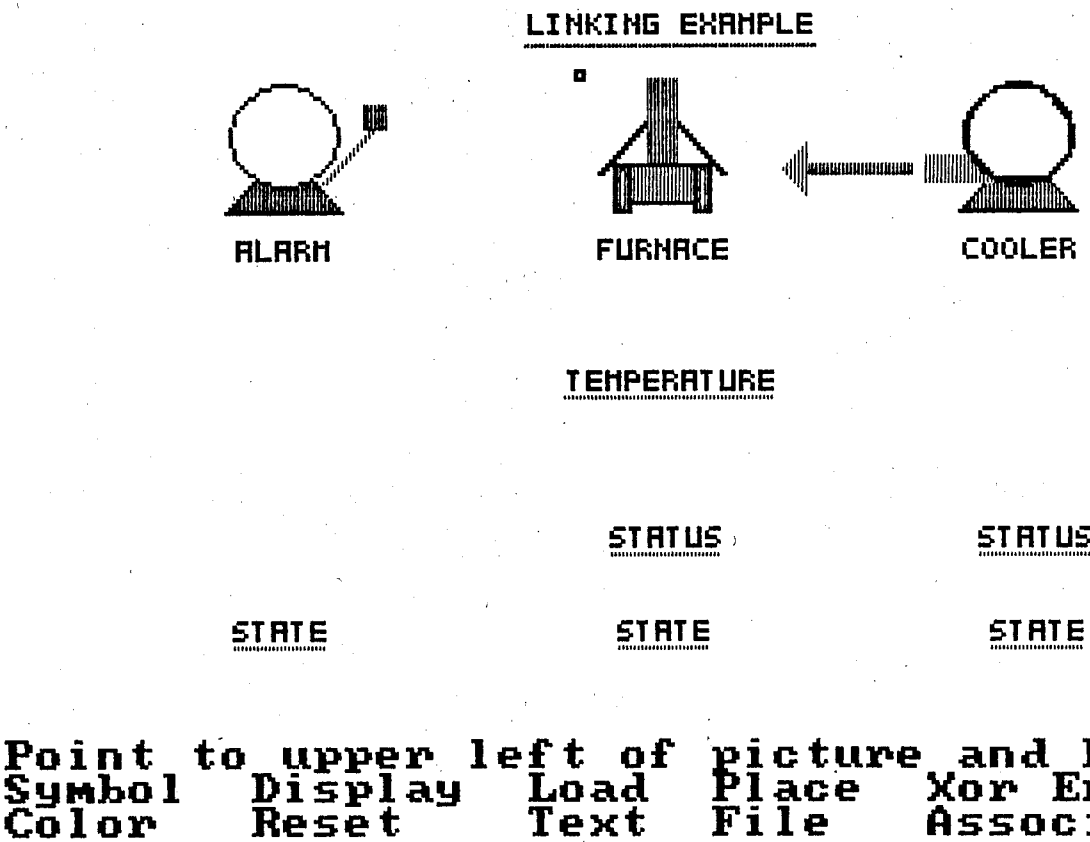

Referring now to FIG. 2, there is shown an illustration of a simple schematic display generated to represent the pedagogical example of FIG. 1. There is a menu at the bottom of the schematic display, and it will be observed that the function <ASSOCIATE>has been selected in order to invoke the linking function. The cursor is then moved above the menu lines and, as shown in FIG. 3, a prompt is presented for a pointing. According to a preferred embodiment of the invention, the pointing is for the upper left corner of the alarm area. Thus, as shown in FIG. 3, the cursor has been placed to the upper left of the funace. When the user presses the ENTER key, the cursor is XORed to remove it from the display and the program begins to draw a small box. The process of drawing the box or similar geometric character is described in more detail in my application Ser. No. 06/531,651, entitled "Geometrical Display Generator" filed concurrently herewith. In the preferred embodiment, a joy stick is used for the cursor control and box generation. For purposes of convenience, the ENTER key may be a button on the joy stick control. The box for the alarm area expands as the user moves the joy stick down to the right. The user can expand the box to enclose the area s/he wants to specify as the alarm area to a maximum x direction of 48 pixels and a maximum y direction of 40 pixels in the preferred embodiment being described. Obviously, these constraints are to a degree arbitrary, and any other dimensional limitations on the size of the box are clearly within the scope and meaning of the invention as defined in the appeded claims.

Figure 4:
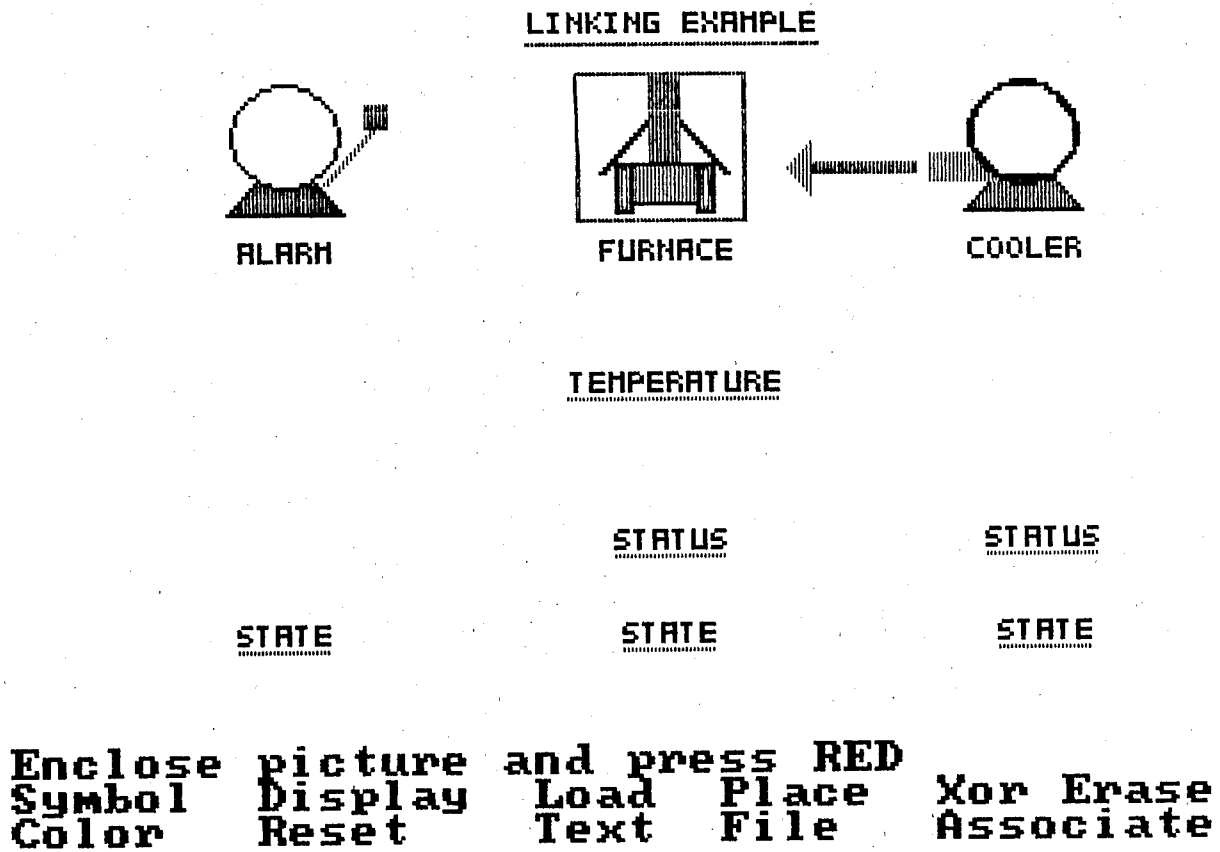

When the box encloses the area to be designated as the alarm area as shown in FIG. 4, the user again presses the joy stick button or ENTER key to signify completion of the designation of the alarm area. The program then stores the starting x and y coordinates in two arrays. The first pointing is the starting area of the alarm box in the dynamic display. The size parameters are the dimensions of the box.

Figure 5:
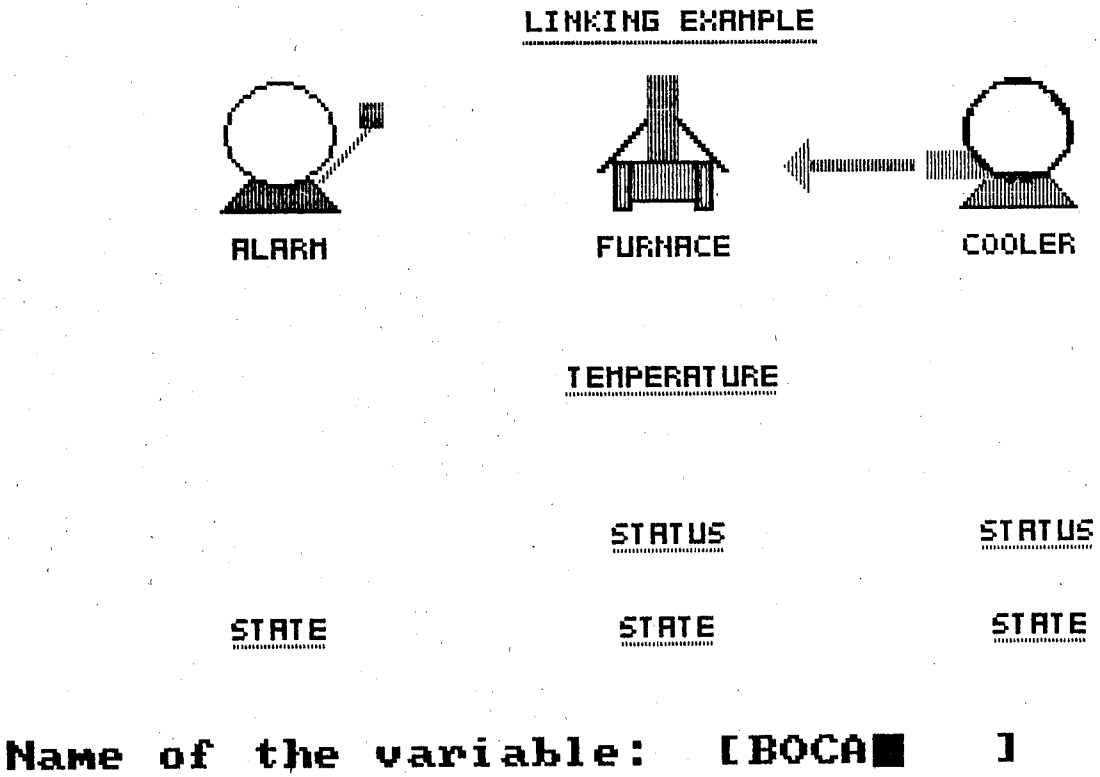
Figure 6:
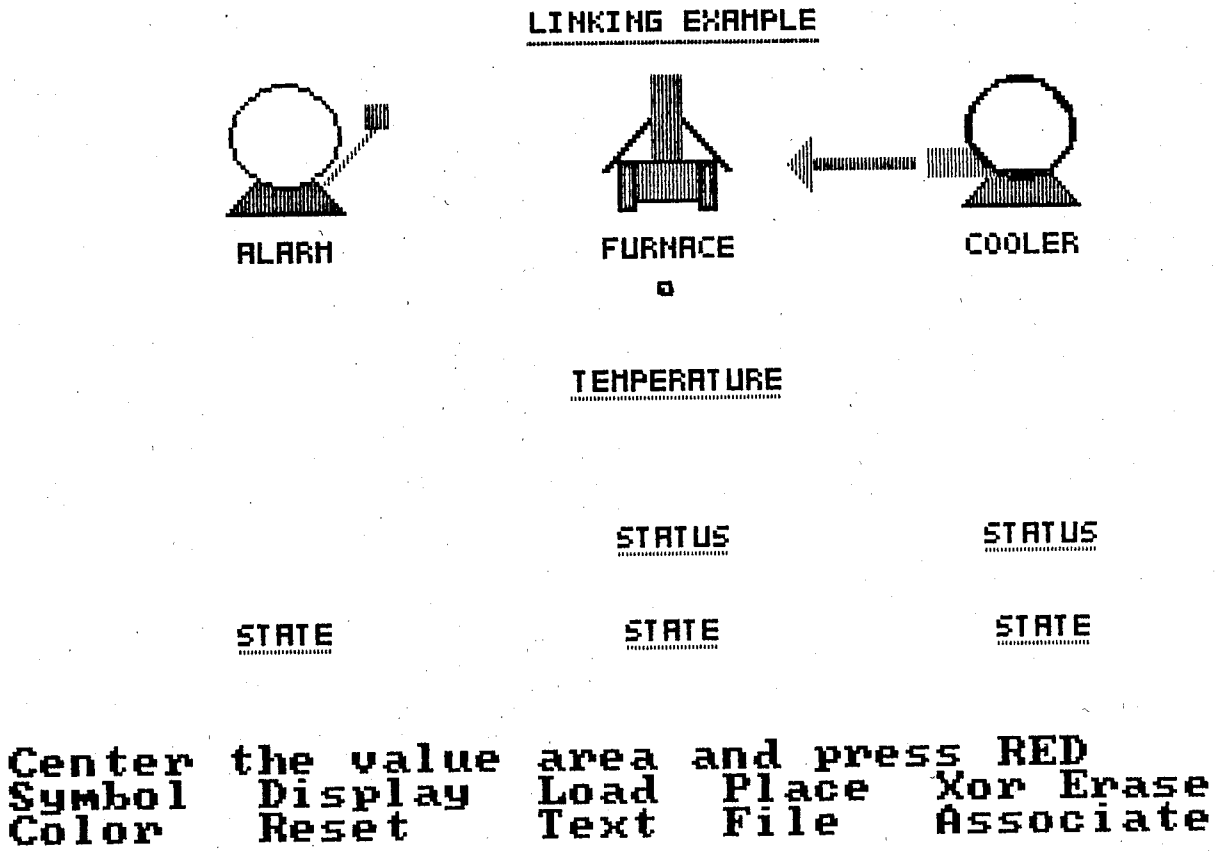

Then the user is prompted for a name as shown in FIG. 5. This name can be a variable name or an alarm/action name as defined in application Ser. No. 06/531,650, entitled "Monitoring and Alarm System for Custom Applications" filed concurrently herewith. If the name is not found in the variable file and the name is not found in the alarm/action file, then an error message is printed and the user is asked if s/he would like to try again. If the user does not wish to try again, then s/he is returned to the function before <ASSOCIATE>was invoked. If a valid name is entered, the program stores the entry number of the variable or alarm/action in an array. Then the user is again prompted for a pointing for the center of the value area as shown in FIG. 6. The user positions the cursor in the center of the area s/he wants the value to be located and presses the joy stick button or the ENTER key. The x and y coordinates of the pointing are saved by the dynamic display for centering the value of an "analog in", the state of a "digital in" and/or a "digital out" or the screen message for the logical group. After this pointing, the user is returned to the function previously active.

Figure 7:
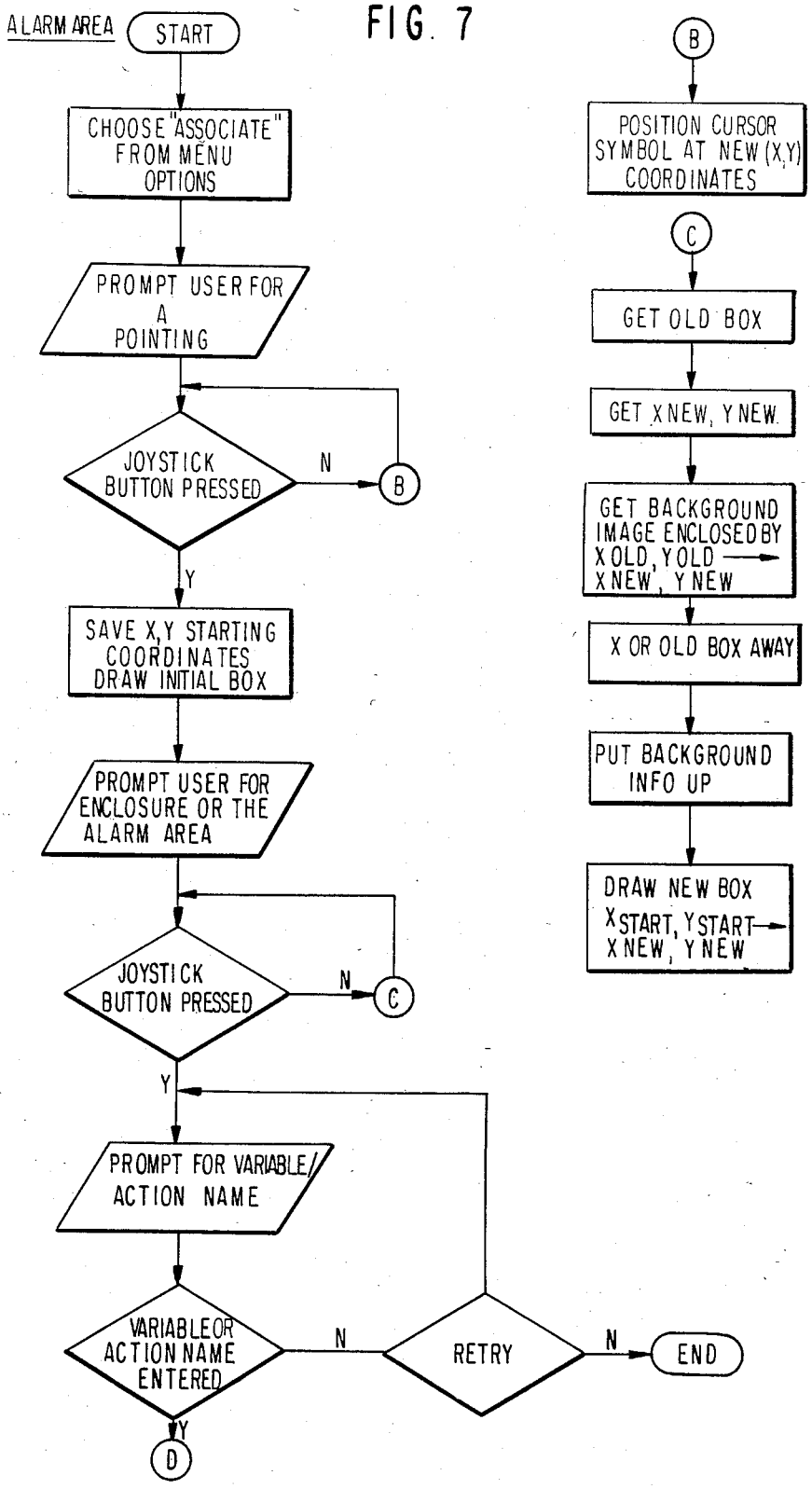
FIGS. 7 and 7A, taken together, are a flow chart summarizing the process of linking the alarm/action variables with the schematic display.
Figure 7A:
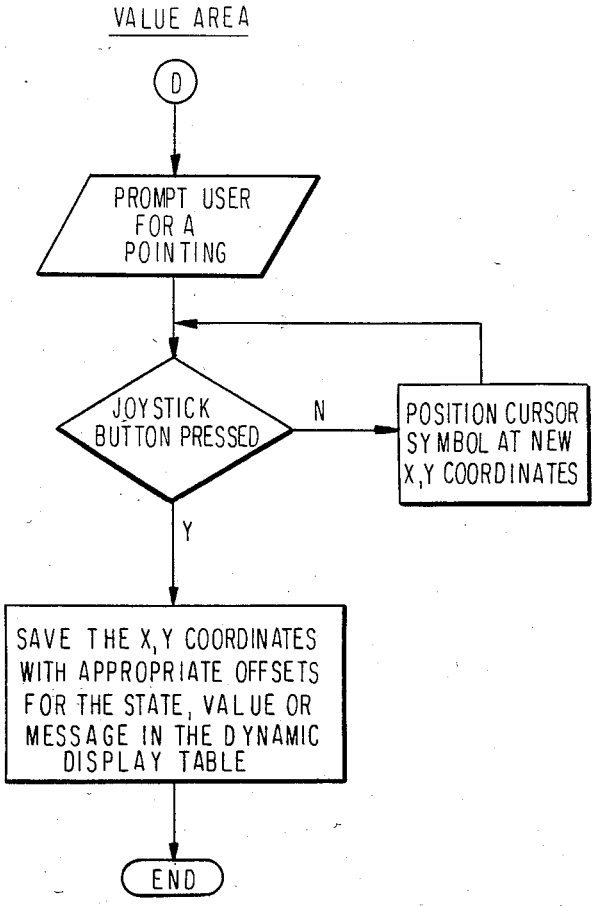

When the user files the schematic, s/he creates two files and makes an entry in a third. The user files the schematic by choosing the <FILE>option from the menu at the bottom of the schematic display. This option prompts the user for a file NAME of eight or fewer characters. Then the user is prompted for a file description of seventy characters or less. These are put in the first available blank record of the display table. Then the background image of the screen is saved in a file called NAME.SCR. Finally, the dynamic display information is stored in a file called NAME.ddt. This file contains a first record specifying how many records are in the file and N records containing the linking information described above, where N stands for the number of entries in the file. The linking process is summarized in the flow chart shown in FIG. 7.

Figure 8:
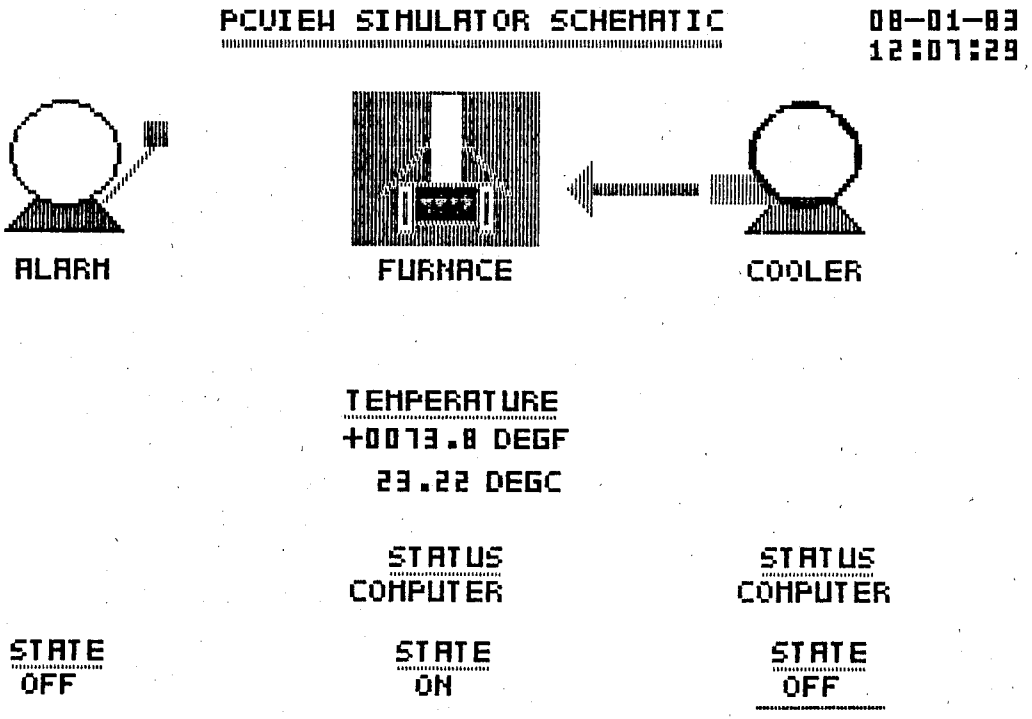
FIG. 8 is an illustration of the schematic display invoked in the dynamic display process showing an alarm condition of the furnace being too cool.

After all the dynamic displays have been generated and stored for a given environment or system being monitored, a specific dynamic display is invoked from a menu selection on the display directory screen. An example of an invoked dynamic display is shown in FIG. 8. This display was invoked using the name "BOCA". The name selected from the display directory is passed to the dynamic display and employed to determine which dynamic display table and background is to be employed The dynamic display creates an in-memory data base of variables, alarm/action entries and dynamic display entries. This data base is used to get alarm messages, blink locations on the screen, determine if alarm/action entries are active and write out history entries. The in-memory data base for variables consists of one multi-entry variable array with "analog ins" at one end and "digital ins" and "digital outs" mixed with timer variables at the other end. This array is 210 entries long with entries 201 to 210 reserved for timer variables. The total number of variables in the system cannot exceed 200, so by expanding the "analog ins" from 0 to increasing numerical values and expanding the "digital ins" and "digital outs" from 199 to decreasing numerical values, array space is conserved. This limitation is due to the requirement in the BASIC programming language of explicitly declaring array sizes. Thus, the limitation is imposed by the programming language used in the preferred embodiment and should not be construed as a limitation on the invention as defined in the appended claims since the use of other programming languages may not impose the same or a similar limitation.

The entries in the variable file for "analog ins" are as follows:

(1) Varentry: Entry number in the variable file for a variable.
(2) Sensor: Type of variable. 1=analog, 2=digital out, 3=digital in, 4=timer.
(3) Cluster: The cluster number.
(4) Chanport: The channel number.
(5) Engunits: Record number in the engunits.tab containing the engineering units for the variable.
(6) Deadband: The alarm deadband for the variable.
(7) Lowlimit: The low alarm limit for the variable.
(8) Highlimit: The high alarm limit for the variable.
(9) Roclimit: The rate of change alarm limit for the variable.
(10) Lowwlimit: The low warning limit for the variable.
(11) Highwlimit: The high warning limit for the variable.
(12) Ratio: The ratio for converting to engineering units.
(13) Yoffset: The y intersect for converting to engineering units
(14) Alarmflag: The alarm mask for the variable.

The entries in the variable file for the "digital ins" and the "digital outs" are as follows:

(1) Varentry: Entry number in the variable file for a variable.
(2) Sensor: Type of variable. 1=analog, 2=digital out, 3=digital in, 4=timer.
(3) Cluster: The cluster number.
(4) Chanport: The port number.
(5) Bit: The bit number.
(6) Zerostat: Record number in the name.tab containing the Name for the zero status of a variable.
(7) Onestat: Record number in the name.tab containing the Name for the one status of a variable.
(8) Alarmflag: The alarm mask for the variable.

The entries in the variable file for timer values are as follows:

(1) Varentry: Entry number in the variable file for a variable.

(2) Elapsed: The amount of elapsed time for the variable.

(3) Time: The amount of time for the timer.

The in-memory data base for alarm/action entries consists of one multi-entry array. The entries in the alarm/action file are as follows:

(1) Logic: A two dimensional array containing the internal pointers to the variable file and the state or limit mask for the entry. The first dimension facilitates the 15 possible logic entries for each logical group. The second dimension facilitates the 200 possible entries in the alarm/action file.

(2) Lentry: The alarm/action entry number.

(3) Scrmessage: Record number in the message.tab containing the user defined screen message.

(4) Botscrmessage: Record number in the message.tab containing the user defined alarm message.

(5) Fullscreen: Record number in the name.tab containing the name of the display to be invoked if the logical group is true.

(6) Event: Entry to determine whether or not to write a record to the event file. 0=no entry, 1=entry.

(7) Alarm: Entry to determine whether or not to write a record to the alarm file. 0=no entry, 1=entry.

(8) Audible: Entry to determine if an audible alarm will be sounded. 0=no audible alarm, 1=short audible alarm, 2=audible alarm until acknowledgement.

(9) Treset: Entry containing the internal pointers the variable file timer to be reset when the logical group becomes true. 0=no entry.

(10) Start: Entry containing the internal pointers to the variable file timer to be started when the logical group becomes true. 0=no entry.

(11) Digitalout: A two dimensional array containing the internal pointers to the variable file and the state mask for the "digital out" entry. The first dimension facilitates the 8 possible "digital out" entries for each logical group. The second dimension facilitates the 200 possible entries in the alarm/action file.

(12) Logicstat: The status mask denoting the current status of each alarm/action entry.

The in-memory data base for dynamic display information consists of one multi-entry array. The entries in the dynamic display file are as follows:

(1) Ddtentry: Internal pointers to the variable or alarm/action file for which the dynamic display information pertains.

(2) Ddttype: The type of entry. 1=variable, 2=alarm/action.

(3) Ulxchar: The upper left x coordinate for the alarm area.

(4) Ulychar: The upper left y coordinate for the alarm area.

(5) Sizex: Size of the alarm area in the x direction.

(6) Sizey: Size of the alarm area in the y direction.

(7) Ulxvalue: The center x coordinate for the value, display message or status message to appear.

(8) Ulyvalue: The center y coordinate for the value, display message or status message to appear.

The first in-memory data base built is the variable file. Each entry from the variable.tab on disk is read into the variable file in memory. No translation is necessary for elements of the variable file. As an entry is read from disk, the type of entry is determined and the proper entries as described above are taken from variable.tab on disk and added to the variable file in memory.

Next, the alarm/action disk is read in. Each entry from the alarm/action file is read from the file on disk and translated into the in-memory data base. As each entry is read, each of the 15 possible logical entries is looked up in the in-memory variable file and replaced with an internal pointer to the variable file. The same process is done for each "digital out" specified. All the other entries specified in the in-memory data base are directly obtained from the disk file.

Next, the dynamic display table is read in. Each entry from the dynamic display file on disk is read into the in-memory data base. As the entries from disk are read, the type of ddt entry is determined, and the entry number is changed into a pointer to the alarm/action file entry in memory or a pointer to the variable file entry in memory.

Next, the background screen is displayed. Then, the initial alarm box is built in memory by setting memory bit patterns.

A loop is then entered to do the data acquisition, check the logical groups and do the dynamic display work. The data acquisition requires going over a comm. link to acquire current values and states. Then the alarm flag entry for each variable is set to reflect the current state of the variable. Valid state masks are as follows:

Hex 8000—High alarm for analog, one state for digital, or time up for a timer variable.

Hex 4000—High warning limit for digital, zero state for digital.

Hex 2000—Rate of change limit for analog, start state for timer variables.

Hex 1000—Low alarm state for analog.

Hex 800—Low warning limit for analog, reset state for timer variable and change of state for digitals.

The logical grouping check requires that each entry in the n-memory alarm/action file be checked against the alarm flag masks identified above. If each logic entry for a given logical group is true, then:

(1) Set the logicstat entry for the logical group =2 if it was less than 2 else 4.

(2) If the in-memory alarm entry>1 then beep.

(3) If the in-memory alarm entry >1 then if logicstat entry=2 then write out alarm file entry.

(4) If the logicstat=2 then:

(a) use the botscrmessage entry if=>0 to get the message from the message file and write it on the screen and the printer;

(b) use the fullscren entry if=>0 to get the fullscreen name of the new display; then read in the new dynamic display file and load the new background screen and reset firstflag;

(c) if the treset entry=>0 then set the alarm flag for reset for the entry specified by treset;

(d) if the start entry=>0 then set the alarm flag for start for the entry specificed by start;

(e) if event is=>0 then write a record to the event file.

(5) For each digitalout entry<>0 set the "digital out" to the specified value.

If any group was not true, then if the logicstat entry <1, then the logicstat entry=1 else the logicstat entry=0. The dynamic display work requires each entry of the in-memory dynamic display file to be checked. If it is an alarm/action definition, then:

(1) if alarming is in effect, then:

(a) set the size of the box to alarm from the in-memory dynamic display sizex and sizey.

(b) set the number of times to blink the area; 3 times initially, 2 while still in alarm, 1 to exit.

(c) do the initial blink of the box and decrement the blink using the ulxchar and ulychar from the in-memory dynamic display data base.

(2) if scrmessage>0then get the screen message from the message file and put it on the screen in the position specified in the in-memory xvalue and yvalue field.

(3) if blink>0 then blink the box and decrement until blink =0.

If it is a variable entry then for an analog variable:

(1) Put the value in the position specified in the in-memory dynamic display data base items ulxvalue and ulyvalue.

(2) If firstflag =0 then use the engunits entry in the variable file in-memory data base and get the engineering units from the engunits.tab. Put them up after the value on the screen.

or for a digital variable:

(1) If a change of state occured (designated by loww in the alarmflag) or if firstflag=0 then:

(a) If alarmflag entry equal to Hia then use the onestat entry to get the 8 character message to appear on the screen and put it at the ulxvalue and ulyvalue from the dynamic display in-memory data base.

(b) If alarmflag entry equal to Hiw then use the zerostat entry to get the 8 character message to appear on the screen and put it at the ulxvalue and ulyvalue from the dynamic display in-memory data base.

The process continues to loop until function key F3, for example, is pressed. The following is the complete program for the preferred embodiment of the invention, which program was written using the IBM Personal Computer BASIC Compiler, version 1.00:

```
Offset  Data    Source Line          IBM Personal Computer BASIC Compiler V1.00

 001A   0002    ' $title:  'PCVIEW/DYNAMIC DISPLAY'
 001A   0002    '
 001A   0002        DEFINT A-Z
 001A   0002        COMSWITCH = 0
 0036   0004    '
 0036   0004        gosub 29999
 003B   0004    '
 003B   0004    '   Umac code (Yech....)
 003B   0004    '
 003B   0004    40 '                                µMAC Driver Initilization
 003C   0004    50 OPTION BASE 0:ON ERROR GOTO 2160
 0044   0004    60 DIM DRIVER(100),DRIVER$(200):'   Dimension Arrays for Driv
                er
 0045   03F2    70 DRIVER$="":DRIVER=0:'            Null Variables for Driver
 0055   03F8    80 DRIVER(99)=0:DRIVER(100)=11
 0063   03F8    90 DRIVER$(100)="CHA":DRIVER$(101)="SCA":DRIVER$(102)="FSC":DRI
                VER$(103)="TEM"
 0087   03F8    100 DRIVER$(104)="SET":DRIVER$(105)="CLE":DRIVER$(106)="TES":DR
                IVER$(107)="DOU":DRIVER$(108)="DIN":DRIVER$(109)="LIM":DRIVER$(
                110)="RES":DRIVER$(111)="RUN":DRIVER$(112)="HAL":DRIVER$(113)="
                SKI":DRIVER$(114)="ACT":DRIVER$(115)="STA"
 00F3   03F8    110 DRIVER$(116)="DEG":DRIVER$(117)="SDA":DRIVER$(118)="RDA":DR
                IVER$(119)="ZDA":DRIVER$(120)="DST"
 0120   03F8    '
 0120   03F8    '   End of umac code (whewwwww.....)
 0120   03F8    '
 0120   03F8    '   Bitmask for determining on/off of digital ins
 0120   03F8    '
 0120   03F8        dim bitmask(7)
 0121   0408    '
 0121   0408    '   Value for future purposes
 0121   0408    '
 0121   0408        dim value!(200)
 0122   072C    '
 0122   072C    '   Dynamic Display Table Arrays
 0122   072C    '
```

```
Offset  Data    Source Line        IBM Personal Computer BASIC Compiler V1.00

0122    072C        dim ddtentry(30)
0123    076A        dim ddttype(30)
0124    07A8        dim ulxchar(30)
0125    07E6        dim ulychar(30)
0126    0B24        dim sizex(30)
0127    0B62        dim sizey(30)
0128    0BA0        dim ulxvalue(30)
0129    0BDE        dim ulyvalue(30)
012A    091C    '
012A    091C    '   Variable arrays
012A    091C    '
012A    091C        dim varentry(210)
012B    0AC2        dim sensor(200)
012C    0C54        dim cluster(200)
012D    0DE6        dim chanport(200)
012E    0F78    '
012E    0F78    '   Analog specific variables
012E    0F78    '
012E    0F78        dim engunits(200)
012F    110A        dim deadband!(200)
0130    142E    '
0130    142E    '   Limits
0130    142E    '
0130    142E        dim lowlimit!(200)
0131    1752        dim highlimit!(200)
0132    1A76        dim roclimit!(200)
0133    1D9A        dim lowwlimit!(200)
0134    20BE        dim highwlimit!(200)
0135    23E2    '
0135    23E2    '   Ratio for conversion to engineering units
0135    23E2    '
0135    23E2        dim ratio!(200)
0136    2706        dim yoffset!(200)
0137    2A2A    '
0137    2A2A    '   Digital Specific Variables
0137    2A2A    '
0137    2A2A        dim bit(200)
0138    2BBC    '
0138    2BBC    '   Status messages
0138    2BBC    '
0138    2BBC        dim zerostat(200)
0139    2D4E        dim onestat(200)
013A    2EE0    '
013A    2EE0    '   Flag for variable being in alarm
013A    2EE0    '
013A    2EE0        dim alarmflag(210)
013B    3086    '
013B    3086    '   Logical Groupings Variables
013B    3086    '
013B    3086        dim logic(200,15)
013C    49A6    '
013C    49A6        dim lentry(200)
013D    4B38        dim scrmessage(200)
013E    4CCA        dim botscrmessage(200)
013F    4E5C        dim fullscreen(200)
```

```
Offset  Data    Source Line        IBM Personal Computer BASIC Compiler V1.00

0140    4FEE        dim event(200)
0141    5180        dim alarm(200)
0142    5312        dim audible(200)
0143    54A4        dim treset(200)
0144    5636        dim start(200)
0145    57C8    '
0145    57C8        dim digitalout(200,7)
0146    6458    '
0146    6458    '   Status of the logical group
0146    6458    '
0146    6458        dim logicstat(200)
0147    65EA    '
0147    65EA    '   Static variables
0147    65EA    '
0147    65EA        smalloff = 20
014E    65EC        blank = 0
0155    65EE        redoffset = 608
015C    65F0        blankoffset = 1112
0163    65F2        xdim = 0
016A    65F4        xptr = varptr(xdim)
0171    65F6    '
0171    65F6    '   Tab vars for Digital out
0171    65F6    '
0171    65F6        tabflag = 0
0178    65F8    '
0178    65F8    '   Initialization variables.
0178    65F8    '
0178    65F8    '   First scan flag
0178    65F8    '
0178    65F8        firstflag = 0
017F    65FA    '
017F    65FA    '   Maximum number of variables
017F    65FA    '
017F    65FA        maxvars = 200
0186    65FC    '
0186    65FC    '   Time variables
0186    65FC    '
0186    65FC        timerec = 201
018D    65FE        dim timeentry(10)
018E    6614        dim elapsed(10)
018F    662A        dim time(10)
0190    6640    '
0190    6640    '   Analog and Digital record numbers
0190    6640    '
0190    6640        drecnum = 0
0197    6642        arecnum = 0
019E    6644        ddtrecnum = 0
01A5    6646    '
01A5    6646    '   Alarm masks for determining states
01A5    6646    '
01A5    6646        hia = &h8000
01AC    6648        hiw = &h4000
01B3    664A        roc = &h2000
01BA    664C        lowa = &h1000
```

```
Offset  Data    Source Line          IBM Personal Computer BASIC Compiler V1.00

01C1    664E         loww = &h800
01C8    6650    '
01C8    6650         offhia = &h7fff
01CF    6652         offhiw = &hbfff
01D6    6654         offroc = &hdfff
01DD    6656         offlowa = &hefff
01E4    6658         offloww = &hf7ff
01EB    665A    '
01EB    665A    '    Masks for stripping off entry and state
01EB    665A    '
01EB    665A         entrymask = &h07ff
01F2    665C         statemask = &hf800
01F9    665E    '
01F9    665E         ON COM(1) GOSUB 9000
0203    665E         COM(1) ON
020A    665E    '
020A    665E         gosub 2220 ' switch to the graphics
020F    665E    '
020F    665E         gosub 4200  ' turn off function keys & enable strig
0214    665E    '
0214    665E         gosub 4500  ' init graphics screen
0219    665E    '
0219    665E         gosub 10000 ' get starting files
021E    665E    '
021E    665E         gosub 4510  ' communications init
0223    665E    '
0223    665E         gosub 13000 ' open engineering units file (3), message fil
                e (4) & names file (5)
022B    665E    '
022B    665E         gosub 12500 'digital out tab de-markation
022D    665E    '
022D    665E         switch = 1
0234    6660    '
0234    6660         while switch
0240    6660    '
0240    6660              gosub 5000  ' analog
0245    6660    '
0245    6660              gosub 6000  ' digital
024A    6660    '
024A    6660              gosub 6250  ' logical groupings
024F    6660    '
024F    6660              gosub 6500  'DDT WORK
0254    6660    '
0254    6660              blank = 0
025B    6660              x = 289
0262    6662              y = 7
0269    6664              length1 = 8
0270    6666              value1$ = time$
0279    666A              gosub 5100 ' put up the time
027E    666A              blank = 1
0285    666A    '
0285    666A              k$ = inkey$
028E    666E              if len(k$) > 1 then gosub 7000 else gosub 6090
02A9    666E    '
```

```
Offset  Data    Source Line          IBM Personal Computer BASIC Compiler V1.00

 02A9   666E          wend
 02AD   666E          end
 02B1   666E    '
 02B1   666E    '     Analog umac code (Yech....)
 02B1   666E    '     Clear Status Register
 02B1   666E    '
 02B1   666E    870 FOR DRIVER=49 TO 69
 02B8   666E    880 DRIVER$(DRIVER)="0"
 02CC   666E    890 NEXT
 02DB   666E    900 '
 02DC   666E    910 FOR DRIVER=70 TO 85
 02E3   666E    920 DRIVER(DRIVER)=VAL(DRIVER$(DRIVER))
 02FF   666E    930 NEXT
 030E   666E    940 '
 030F   666E    950 DRIVER(81)=DRIVER(71)
 0316   666E    960 IF (DRIVER(70)=6) THEN DRIVER(71)=DRIVER(99):DRIVER(72)=DRI
                VER(100)
 032F   666E    970 IF (DRIVER(70)=4 OR DRIVER(70)=7) THEN DRIVER(72)=DRIVER(71
                )
 0356   666E    980 '
 0357   666E    990 ' Check for default setup (#1)
 0358   666E    1000 IF DRIVER(70)<>1 THEN GOTO 1070
 0367   666E    1010 DRIVER$(82)="1":DRIVER$(75)="2":DRIVER$(76)="9600":DRIVER$
                (77)="0"
 038B   666E    1020 GOTO 2140
 038F   666E    1030 '
 0390   666E    1040 '   Command Interpreter for 2-24 to Follow
 0391   666E    1050 '
 0392   666E    1060 '   2 - Initilize Interface
 0393   666E    1070 IF DRIVER(70)<>2 THEN GOTO 1140
 03A2   666E    1080 CLOSE 1
 03A9   666E    1090 DRIVER$="COM"+DRIVER$(82)+":"+DRIVER$(76)+",O,7"
 03C9   666E    1100 OPEN DRIVER$ AS #1
 03DB   666E    1110 GOTO 2140
 03DF   666E    1120 '
 03E0   666E    1130 '     3 - Send Cancel (ctrl-X)
 03E1   666E    1140 IF DRIVER(70)<>3 THEN GOTO 1180
 03F0   666E    1150 PRINT #1,CHR$(24): GOTO 2140
 0402   666E    1160 '
 0403   666E    1170 '     Build command string
 0404   666E    1180 DRIVER$="$"+DRIVER$(77)+":"+DRIVER$(DRIVER(70)+96)
 042B   666E    1190 IF (DRIVER(70)=17 OR (DRIVER(70)>19 AND DRIVER(70)<25 AND
                DRIVER(70)<>21 AND DRIVER(70)<>23) OR DRIVER(70)=4 OR DRIVER(70
                )=12 OR DRIVER(70)=7) THEN DRIVER$=DRIVER$+"/"+DRIVER$(71)
 04AC   666E    1200 IF (DRIVER(70)=21 OR DRIVER(70)=18 OR DRIVER(70)=5 OR (DRI
                VER(70)>7 AND DRIVER(70)<12)) THEN DRIVER$=DRIVER$+"/"+DRIVER$(
                71)+"/"+DRIVER$(72)
 051A   666E    1210 IF DRIVER(70)=13 THEN DRIVER$=DRIVER$+"/"+DRIVER$(71)+"/"+
                DRIVER$(72)+"/"+DRIVER$(73)
 055C   666E    1220 '
 055D   666E    1230 '       Add Checksum to Command
 055E   666E    1240 DRIVER(78)=0 :DRIVER$=DRIVER$+":":DRIVER$(130)=DRIVER$:DRI
                VER$=""
 0583   666E    1250 FOR DRIVER=1 TO LEN(DRIVER$(130))
```

```
Offset  Data    Source Line          IBM Personal Computer BASIC Compiler V1.00

 0593   6670    1260 IF (MID$(DRIVER$(130),DRIVER,1)<>CHR$(32)) THEN DRIVER$=DR
                IVER$+MID$(DRIVER$(130),DRIVER,1)
 05C7   6670    1270 NEXT
 05D8   6670    1280 FOR DRIVER=1 TO LEN(DRIVER$)
 05E8   6672    1290 DRIVER(78)=DRIVER(78)+ASC(MID$(DRIVER$,DRIVER,1))
 0600   6672    1300 NEXT
 0611   6672    1310 DRIVER$=DRIVER$+MID$(HEX$(DRIVER(78)),LEN(HEX$(DRIVER(78))
                )-1,2)
 0635   6672    1320 '
 0636   6672    1330 '   Reset Re-Try Counter
 0637   6672    1340 DRIVER(80)=0
 063E   6672    1350 '
 063F   6672    1360 '   Initilize Data
 0640   6672    1370 DRIVER(79)=0:DRIVER$(200)="":DRIVER(50)=0
 0657   6672    1380 '
 0658   6672    1390 '    Talk to µMAC
 0659   6672    '
 0659   6672    '    talk and walk with the controller
 0659   6672    '
 0659   6672    1400 PRINT #1,DRIVER$
 0664   6672    1410 FOR driver = 1 to 10000
 066B   6672    1420      IF COMSWITCH = 1 then 1450
 0676   6672    1430 next
 0686   6672    1440 driver$(50) = "1"
 068F   6672    1441 driver$(51) = "1"
 069B   6672    1442 goto 2080
 069C   6672    '
 069C   6672    '    Start of the communications received
 069C   6672    '
 069C   6672    1450 COMSWITCH = 0
 06A3   6672    1455 FOR DRIVER = 1 to 1000
 06AA   6672    1456      i = i + i: i = 0
 06BA   6674    1457 next driver
 06CA   6674    1460 IF (LOC(DRIVER(82))>71) THEN 1500
 06DA   6674    1470 DRIVER(78)=LOC(DRIVER(82))
 06E6   6674    1480 IF (DRIVER(78)-LOC(DRIVER(82))=0) THEN DRIVER(79)=DRIVER(7
                9)+1 ELSE DRIVER(79)=0
 070D   6674    1490 IF DRIVER(79)<(50-5*(DRIVER(76)/1000)) THEN 1460
 072C   6674    1500 IF (LOC(DRIVER(82))<72) THEN DRIVER$(200)=INPUT$(LOC(DRIVE
                R(82)),#1) ELSE DRIVER$(200)=INPUT$(72,#1)
 0761   6674    1510 '
 0762   6674    1520 '     Check checksum
 0763   6674    1530 IF DRIVER$=MID$(DRIVER$(200),1,LEN(DRIVER$(200))-1) THEN D
                RIVER$(50)="1":DRIVER$(51)="1" :GOTO 2090
 0798   6674    1540 DRIVER(78)=0:DRIVER$(130)=MID$(DRIVER$(200),LEN(DRIVER$(20
                0))-3,2)
 07B7   6674    1550 FOR DRIVER= 1 TO (LEN(DRIVER$(200))-4)
 07CB   6676    1560 DRIVER(78)=DRIVER(78)+ASC(MID$(DRIVER$(200),DRIVER,1))
 07E3   6676    1570 NEXT
 07F4   6676    1580 IF (MID$(HEX$(DRIVER(78)),LEN(HEX$(DRIVER(78)))-1,2)=DRIVE
                R$(130)) THEN 1610
 081B   6676    1590 DRIVER$(54)="1":DRIVER$(50)="1"
 082D   6676    1600 GOTO 2090
 0831   6676    1610 '
 0832   6676    1620 '
```

```
Offset  Data    Source Line          IBM Personal Computer BASIC Compiler V1.00

0833    6676    1630 '     Breakdown Status Word
0834    6676    1640 DRIVER$(140)=MID$(DRIVER$(200),2,1)
0846    6676    1650 DRIVER$(150)=MID$(DRIVER$(200),3,1)
0858    6676    1660 IF ASC(DRIVER$(140))>64 THEN DRIVER$(140)=STR$(ASC(DRIVER$
                (140))-55)
0876    6676    1670 IF ASC(DRIVER$(150))>64 THEN DRIVER$(150)=STR$(ASC(DRIVER$
                (150))-55)
0894    6676    1680 DRIVER(78)=VAL(DRIVER$(140)):DRIVER(79)=VAL(DRIVER$(150))
08AE    6676    1690 DRIVER$(49)=MID$(DRIVER$(200),2,2)
08BF    6676    1700 IF SGN(DRIVER(78)-8)>-1 THEN DRIVER$(55)="1":DRIVER(78)=DR
                IVER(78)-8:DRIVER(99)=0:DRIVER(100)=11:'SET DEFAULT ACTIVE RANG
                E
08FB    6676    1710 IF SGN(DRIVER(78)-4)>-1 THEN DRIVER$(56)="1":DRIVER(78)=DR
                IVER(78)-4
092B    6676    1720 IF SGN(DRIVER(78)-2)>-1 THEN DRIVER$(57)="1":DRIVER(78)=DR
                IVER(78)-2
0957    6676    1730 IF SGN(DRIVER(78)-1)>-1 THEN DRIVER$(58)="1":DRIVER(78)=DR
                IVER(78)-1
0981    6676    1740 IF SGN(DRIVER(79)-8)>-1 THEN DRIVER$(59)="1":DRIVER(79)=DR
                IVER(79)-8
09AF    6676    1750 IF SGN(DRIVER(79)-4)>-1 THEN DRIVER$(60)="1":DRIVER(79)=DR
                IVER(79)-4
09DF    6676    1760 IF SGN(DRIVER(79)-2)>-1 THEN DRIVER$(61)="1":DRIVER(79)=DR
                IVER(79)-2
0A0B    6676    1770 IF SGN(DRIVER(79)-1)>-1 THEN DRIVER$(62)="1":DRIVER(79)=DR
                IVER(79)-1
0A35    6676    1780 IF DRIVER$(56)="1" THEN DRIVER$(50)="1"
0A4C    6676    1790 IF DRIVER$(57)="1" THEN DRIVER$(50)="1"
0A63    6676    1800 '
0A64    6676    1810 '     Distribute Data
0A65    6676    1820 IF (DRIVER$(50)="1") THEN 2080
0A73    6676    1830 IF ((DRIVER(70)>3 AND DRIVER(70)<8) OR DRIVER(70)=22) THEN
                 1890
0AA0    6676    1840 IF (DRIVER(70)=10) THEN 2030
0AAB    6676    1850 IF (DRIVER(70)=12 OR DRIVER(70)=24) THEN 2060
0ACB    6676    1860 GOTO 2090
0ACF    6676    1870 '
0AD0    6676    1880 '     Evaluate Analog Data
0AD1    6676    1890 DRIVER(78)=5
0AD8    6676    1900 FOR DRIVER =DRIVER(71) TO DRIVER(72)
0AE5    6678    1910 DRIVER$=MID$(DRIVER$(200),DRIVER(78),7)
0AF8    6678    1920 IF DRIVER$="NULL CH" THEN DRIVER$="1E20"
0B0F    6678    1930 IF DRIVER$="+OVLOAD" THEN DRIVER$="1E10"
0B26    6678    1940 IF DRIVER$="-OVLOAD" THEN DRIVER$="-1E10"
0B3D    6678    1950 DRIVER$(DRIVER)=DRIVER$
0B51    6678    1960 IF ABS(VAL(DRIVER$(DRIVER)))>1E+09 THEN DRIVER$(63)="1"
0B77    6678    1970 DRIVER(78)=DRIVER(78)+8
0BB1    6678    1980 IF (DRIVER=(DRIVER(71)+8)) THEN DRIVER=DRIVER(72)
0B99    6678    1990 NEXT
0BAD    6678    2000 GOTO 2090
0BB1    6678    2010 '
0BB2    6678    2020 '     Load Test Results
0BB3    6678    2030 DRIVER$(48)=MID$(DRIVER$(200),5,1):GOTO 2090
0BC9    6678    2040 '
0BCA    6678    2050 '     Load Digital Results
```

```
Offset  Data    Source Line          IBM Personal Computer BASIC Compiler V1.00

0BCB    6678    2060 DRIVER$(48)=MID$(DRIVER$(200),5,2)
0BDD    6678    2070 '
0BDE    6678    2080 '     Check for Re-Try
0BDF    6678    2090 IF (DRIVER$(50)<>"1") THEN 2110
0BED    6678    2100 DRIVER(80)=DRIVER(80)+1:IF DRIVER(80)<=DRIVER(75) THEN GOT
                O 1370
0C06    6678    2110 IF (EOF(DRIVER(82))<>-1) THEN DRIVER(71)=DRIVER(71)+8 :GOT
                O 1410
0C24    6678    2120 DRIVER(71)=DRIVER(81)
0C2B    6678    2130 '
0C2C    6678    2140 IF (DRIVER$(50)<>"1" AND DRIVER$(70)="18") THEN DRIVER(99)
                =VAL(DRIVER$(71)):DRIVER(100)=VAL(DRIVER$(72))
0C6C    6678    2150 RETURN
0C6F    6678    2160 '     Error trapping routine
0C70    6678    2170 DRIVER$(50)="1":DRIVER$(64)="1"
0C82    6678    2180 IF (ERR=24 OR ERR=57) THEN DRIVER$(51)="1":DRIVER$(64)="0"
0CB6    6678    2190 IF ERR=25 THEN DRIVER$(53)="1":DRIVER$(64)="0"
0CD4    6678    2200 RESUME 2140
0CDB    6678    2210 '*****     End of µMAC Driver     *****
0CDC    6678    '
0CDC    6678    '    This ends the umac code (Thank goodness)
0CDC    6678    '
0CDC    6678    2220 '
0CDD    6678    '
0CDD    6678    '   switch to color
0CDD    6678    '
0CDD    6678         DEF SEG = 0
0CE3    6678         A = PEEK(&H410)
0CF5    667A         WIDTH 80
0CFC    667A         POKE &H410,(A AND &HCF) OR &H20
0D14    667A         WIDTH 40
0D1B    667A         SCREEN 1
0D22    667A         SCREEN 0
0D28    667A         LOCATE ,,1,6,7
0D41    667A         SCREEN 1
0D48    667A         COLOR 16,0
0D54    667A         CLS
0D58    667A         DEF SEG
0D5C    667A    '
0D5C    667A         RETURN
0D5F    667A    '
0D5F    667A    2400 '
0D60    667A    '
0D60    667A    '    Clear the screen
0D60    667A    '
0D60    667A         LOCATE 23,1
0D6D    667A         PRINT STRING$(39," ");
0D7B    667A    '
0D7B    667A         LOCATE 24,1
0D88    667A         PRINT STRING$(39," ");
0D96    667A    '
0D96    667A         LOCATE 25,1
0DA3    667A         PRINT STRING$(39," ");
0DB1    667A    '
```

```
Offset  Data    Source Line          IBM Personal Computer BASIC Compiler V1.00

0DB1    667A          RETURN
0DB4    667A    '
0DB4    667A    2550 '
0DB5    667A    '
0DB5    667A    '     Error handler
0DB5    667A    '
0DB5    667A          gosub 2400 ' clear the error screen
0DBA    667A    '
0DBA    667A    '     First row error messages
0DBA    667A    '
0DBA    667A          LOCATE 23,1
0DC7    667A    '
0DC7    667A          if driver$(51) <> "0" then print " ### A timeout has occur
                red. ";: comerr = 1
0DE4    667C          if driver$(52) <> "0" then print " ### Illegal value in bu
                ffer. ";
0DFA    667C          if driver$(53) <> "0" then print " ### Interface hardware
                problem. ";: comerr = 1
0E17    667C          if driver$(54) <> "0" or driver$(56) <> "0" then print " #
                ## Checksum error has occurred. ";
0E42    667C          if driver$(55) <> "0" then print " ### Umac has been reset
                . ";
0E58    667C          if driver$(57) <> "0" then print " ### Syntax error. ";
0E6E    667C          if driver$(58) <> "0" then print " ### Context error. ";
0E84    667C          if driver$(59) <> "0" then print " ### Parity error. ";
0E9A    667C          if driver$(64) <> "0" then print " ### System Error Occurr
                ed. ";: comerr = 2
0EB7    667C    '
0EB7    667C    '     Two row error messages
0EB7    667C    '
0EB7    667C          LOCATE 24,1
0EC4    667C    '
0EC4    667C          IF COMERR = 1 THEN PRINT " ### Check communications link"
                ;
0ED7    667C    '
0ED7    667C          If comerr = 2 then print " ### Continue? [ ]";
0EEA    667C          if comerr = 2 then locate 24,17
0F02    667C          If comerr = 2 then input ; "", y$: if y$ <> "Y" and y$ <>
                 "y" then gosub 32767 else gosub 2400
0F4D    6680    '
0F4D    6680          RETURN
0F50    6680    '
0F50    6680    3000 '
0F51    6680    '
0F51    6680    '     Analog variable entry
0F51    6680    '
0F51    6680          field #1,2 as senseup$,8 as varup$,2 as clusterup$,2 as et
                $,2 as channelup$,2 as engup$,4 as deadup$,4 as lowlup$,4 as hl
                up$,4 as rocup$,4 as lwlup$,4 as hwlup$,4 as zengup$,4 as fengu
                p$,4 as ratio$, 10 as fill$
0FD7    66C0    '
0FD7    66C0          arraynum = arecnum
0FDE    66C2          arecnum = arecnum + 1
0FE6    66C2    '
```

```
Offset  Data    Source Line        IBM Personal Computer BASIC Compiler V1.00

 0FE6   66C2    '    Type of sensor( 1 = ai, 2 = do, 3 = di
 0FE6   66C2    '
 0FE6   66C2         sensor(arraynum) = cvi(senseup$)
 0FF7   66C2    '
 0FF7   66C2    '    Limits
 0FF7   66C2    '
 0FF7   66C2         lowlimit!(arraynum) = cvs(lowlup$)
 100C   66C2         highlimit!(arraynum) = cvs(hlup$)
 1021   66C2         roclimit!(arraynum) = cvs(rocup$)
 1036   66C2         lowwlimit!(arraynum) = cvs(lwlup$)
 104B   66C2         highwlimit!(arraynum) = cvs(hwlup$)
 1060   66C2
 1060   66C2    '
 1060   66C2    '    Engineering Units Pointer
 1060   66C2    '
 1060   66C2         engunits(arraynum) = cvi(engup$)
 1071   66C2    '
 1071   66C2    '    Hardware information
 1071   66C2    '
 1071   66C2         chanport(arraynum) = cvi(channelup$)
 1082   66C2         cluster(arraynum) = cvi(clusterup$)
 1093   66C2    '
 1093   66C2    '    Get the variable entry number for lookup of the DDT entry.
 1093   66C2    '
 1093   66C2         varentry(arraynum) = cvi(et$)
 10A4   66C2    '
 10A4   66C2    '    Get the ratio
 10A4   66C2    '
 10A4   66C2         ratio!(arraynum) = cvs(ratio$)
 10B9   66C2         yoffset!(arraynum) = cvs(zengup$)
 10CE   66C2    '
 10CE   66C2    '    Get the dead band
 10CE   66C2    '
 10CE   66C2         deadband!(arraynum) = cvs(deadup$)
 10E3   66C2    '
 10E3   66C2         return
 10E6   66C2    '
 10E6   66C2    3100 '
 10E7   66C2    '
 10E7   66C2    '    Digital variable entry
 10E7   66C2    '
 10E7   66C2         arraynum = maxvars - drecnum
 10F2   66C2         drecnum = drecnum + 1
 10FA   66C2    '
 10FA   66C2    '    Put up the data
 10FA   66C2    '    Status message
 10FA   66C2    '
 10FA   66C2         zerostat(arraynum) = cvi(zerosup$)
 110B   66C6         onestat(arraynum) = cvi(onesup$)
 111C   66CA    '
 111C   66CA    '    Get the variable entry number for lookup of the DDT entry.
 111C   66CA    '
 111C   66CA         varentry(arraynum) = cvi(et$)
 112D   66CA    '
 112D   66CA    '    Hardware address
```

```
Offset  Data    Source Line          IBM Personal Computer BASIC Compiler V1.00

112D    66CA    '
112D    66CA        bit(arraynum) = cvi(bitup$)
113E    66CE        chanport(arraynum) = cvi(portup$)
114F    66D2    '
114F    66D2    '   Unac cluster number
114F    66D2    '
114F    66D2        cluster(arraynum) = cvi(clusterup$)
1160    66D2    '
1160    66D2    '   Type of sensor( 1 = ai, 2 = do, 3 = di
1160    66D2    '
1160    66D2        sensor(arraynum) = cvi(senseup$)
1171    66D2    '
1171    66D2        return
1174    66D2    '
1174    66D2    3150 '
1175    66D2    '
1175    66D2    '   Get the timer variable parameters in.
1175    66D2    '
1175    66D2        time(timerec - 201) = cvi(portup$)
1186    66D2        varentry(timerec) = cvi(et$)
1197    66D2    '
1197    66D2        timerec = timerec + 1
119F    66D2    '
119F    66D2        return
11A2    66D2    '
11A2    66D2    3200 '
11A3    66D2    '
11A3    66D2    '   ddt getter
11A3    66D2    '
11A3    66D2        firstlogic = 0
11AA    66D4        for ddtrecno = 0 to ddtrecs - 1
11B7    66D8    '
11B7    66D8            get #2, ddtrecno + 2
11C4    66DA    '
11C4    66DA            ddttype(ddtrecno) = cvi(typeddt$)
11D5    66DE            ddtentry(ddtrecno) = cvi(entry$)
11E6    66E2    '
11E6    66E2    '   Resolve entry numbers into arraynum values
11E6    66E2    '
11E6    66E2            if ddttype(ddtrecno) = 1 then gosub 3210 else gosub 3220
1204    66E2            if ddttype(ddtrecno) = 1 then if sensor(ddtentry(ddtrecno))
                = 2 then digouts = digouts + 1
1234    66E4    '
1234    66E4            ulxchar(ddtrecno) = cvi(ulxchar$)
1245    66E8            ulychar(ddtrecno) = cvi(ulychar$)
1256    66EC            sizex(ddtrecno) = cvi(boxx$)
1267    66F0            sizey(ddtrecno) = cvi(boxy$)
1278    66F4            ulxvalue(ddtrecno) = cvi(ulxvalue$)
1289    66F8            ulyvalue(ddtrecno) = cvi(ulyvalue$)
129A    66FC    '
129A    66FC        next ddtrecno
12AE    66FC    '
12AE    66FC        return
12B1    66FC    '
12B1    66FC    3210 '
```

```
Offset  Data    Source Line          IBM Personal Computer BASIC Compiler V1.00

 12B2   66FC    '
 12B2   66FC    '    Get variable arraynum
 12B2   66FC    '
 12B2   66FC         b = 0
 12B9   66FE         c = numanalog
 12C0   6702         for i = 1 to 2
 12C7   6702    '
 12C7   6702              for j = b to c
 12D4   6704                   if ddtentry(ddtrecno) = varentry(j) then ddtentry(ddtre
                cno) = j: return
 1300   6706              next j
 1311   6706    '
 1311   6706              if i = 1 then b = digitals: c = maxvars
 132A   6708    '
 132A   6708         next i
 1339   6708    '
 1339   6708         locate 23,1
 1346   6708         print "*** Varentry not found... ";
 134E   6708    '
 134E   6708         return
 1351   6708    '
 1351   6708    3220 '
 1352   6708    '
 1352   6708    '    Get Logical arraynum
 1352   6708    '
 1352   6708         for i = 0 to numsrecs - 1
 135F   670C              if ddtentry(ddtrecno) = lentry(i) then ddtentry(ddtrecno) =
                i: return
 138B   670C         next
 139C   670C    '
 139C   670C         locate 23,1
 13A9   670C         print "*** Logical entry not found... ";
 13B1   670C    '
 13B1   670C         return
 13B4   670C    '
 13B4   670C    4000 '
 13B5   670C    '
 13B5   670C    '    Disk error
 13B5   670C    '
 13B5   670C         gosub 2400
 13BA   670C         locate 23,1
 13C7   670C         print "Error trying to open:  "; ddt$;
 13D4   6710         nofilefl = 1
 13DB   6712         for a = 1 to 10000: j = 0: next
 13F9   6712         resume next
 13FD   6712    '
 13FD   6712    4200 '
 13FE   6712    '
 13FE   6712    '    Turn off all function keys
 13FE   6712    '
 13FE   6712         for i = 1 to 10
 1405   6712              key(i) off
 140D   6712         next i
 141C   6712         for i = 1 to 10
```

```
Offset  Data    Source Line          IBM Personal Computer BASIC Compiler V1.00

 1423   6712            key i, ""
 142E   6712        next i
 143D   6712   '
 143D   6712        return
 1440   6712   '
 1440   6712   4500 '
 1441   6712   '
 1441   6712   '    get symbol table in
 1441   6712   '    storage segment register fetch
 1441   6712   '
 1441   6712        def seg = 0
 1447   6712        storage = peek(&h3fe) + 256 * peek(&h3ff)
 147A   6714        def seg = storage
 1482   6714   '
 1482   6714        bload "small.sym", smalloff
 148D   6714   '
 148D   6714   '    set up the red area
 148D   6714   '
 148D   6714        for i = 0 to 504
 1493   6714            poke redoffset + i, 170
 14A7   6714        next i
 14B7   6714        poke redoffset, 98
 14C7   6714        poke redoffset + 1, 0
 14D7   6714        poke redoffset + 2, 42
 14E9   6714        poke redoffset + 3, 0
 14FB   6714   '
 14FB   6714   '    Set up the blank area
 14FB   6714   '
 14FB   6714        for i = 0 to 504
 1501   6714            poke blankoffset + i, 0
 1514   6714        next i
 1524   6714   '
 1524   6714   '    Y is always 5 for blanking.
 1524   6714   '
 1524   6714        poke blankoffset + 2, 5
 1536   6714   '
 1536   6714        def seg
 153A   6714   '
 153A   6714   '    initialize the alarm flags
 153A   6714   '
 153A   6714        for i = 0 to maxvars
 1546   6716            alarmflag(i) = 0
 1553   6716            value!(i) = -999
 1565   6716            cluster(i) = -1
 1572   6716        next i
 1583   6716   '
 1583   6716        gosub 4505
 1588   6716   '
 1588   6716        return
 158B   6716   '
 158B   6716   4505 '
 158C   6716   '
 158C   6716   '    load the background screen
 158C   6716   '
 158C   6716   '    Initialize the tabbing areas.
```

```
Offset  Data    Source Line          IBM Personal Computer BASIC Compiler V1.00

158C    6716    '
158C    6716        firsttab = 0
1593    6718        digouts = 0
159A    6718    '
159A    6718        def seg = &hb800
15A1    6718        ddt$ = ddtfile$ + ".scr"
15AF    671C        bload ddt$,0
15B8    671C        def seg
15BC    671C        gosub 2400
15C1    671C    '
15C1    671C    '   date
15C1    671C    '
15C1    671C        blank = 0
15C8    671C        value1$ = date$
15D1    671C        value1$ = left$(value1$,6) + right$(value1$,2)
15ED    671C        x = 289
15F4    671C        y = 0
15FB    671C        length1 = len(value1$)
1605    671C        gosub 5100  ' put up the date
160A    671C        blank = 1
1611    671C    '
1611    671C        return
1614    671C    '
1614    671C    4510 '
1615    671C    '
1615    671C    '   General communications initialization for the umac.
1615    671C    '
1615    671C        driver$(70) = "1"
161E    671C        gosub 870
1623    671C    '
1623    671C    '   Put the error checking code here.
1623    671C    '
1623    671C        if driver$(50) <> "0" then gosub 2550
1636    671C    '
1636    671C        driver$(70) = "2"
163F    671C        gosub 870
1644    671C    '
1644    671C    '   Put the error checking code here.
1644    671C    '
1644    671C        if driver$(50) <> "0" then gosub 2550
1657    671C    '
1657    671C    '   Status check.
1657    671C    '
1657    671C        driver$(70) = "19"
1660    671C        gosub 870
1665    671C    '
1665    671C    '   Put the error checking code here.
1665    671C    '
1665    671C        if driver$(50) <> "0" then gosub 2550
1678    671C    '
1678    671C        driver$(70) = "20"
1681    671C        driver$(71) = "F"
168A    671C        gosub 870
168F    671C    '
168F    671C    '   Put the error checking code here.
```

```
Offset  Data    Source Line          IBM Personal Computer BASIC Compiler V1.00

 168F   671C    '
 168F   671C        if driver$(50) <> "0" then gosub 2550
 16A2   671C    '
 16A2   671C    '   Set up limits of active channels for analog in.
 16A2   671C    '
 16A2   671C        cluster1 = cluster(0)
 16A9   671E        counter = 0
 16B0   6720        big = -1
 16B7   6722        small = 9999
 16BE   6724        l = 0
 16C5   6726    '
 16C5   6726    '   First determine the large and small analog channels and po
                rts
 16C5   6726    '
 16C5   6726        while l <= numanalog
 16D2   6726    '
 16D2   6726            while cluster1 = cluster(l)
 16E6   6726    '
 16E6   6726                if chanport(l) > big then big = chanport(l)
 170B   6726                if chanport(l) < small then small = chanport(l)
 172A   6726                l = l + 1
 1732   6726    '
 1732   6726            wend
 1736   6726    '
 1736   6726    '   Send out limits to the Umac.
 1736   6726    '
 1736   6726            driver$(77) = str$(cluster1)
 1743   6726            driver$(70) = "18"
 174C   6726            driver$(71) = str$(small)
 1759   6726            driver$(72) = str$(big)
 1766   6726            gosub 870
 176B   6726    '
 176B   6726    '   Put the error checking code here!!!!!!!!
 176B   6726    '
 176B   6726        if driver$(50) <> "0" then gosub 2550
 177E   6726    '
 177E   6726            counter = counter + 1
 1786   6726            big = -1
 178D   6726            small = 999
 1794   6726            cluster1 = cluster(l)
 17A2   6726    '
 17A2   6726        wend
 17A6   6726    '
 17A6   6726    '   Reset tabflag for initialization of DO marking.
 17A6   6726    '
 17A6   6726        tabflag = 0
 17AD   6726    '
 17AD   6726    return
 17B0   6726    '
 17B0   6726    5000 '
 17B1   6726    '
 17B1   6726    '   Analog handler
 17B1   6726    '
 17B1   6726        arraynum = 0
 17B8   6726        cluster1 = cluster(arraynum)
```

```
Offset  Data    Source Line          IBM Personal Computer BASIC Compiler V1.00

17C6    6726    '
17C6    6726         while arraynum <= numanalog
17D3    6726    '
17D3    6726              driver$(77) = str$(cluster1)
17E0    6726              driver$(70) = "6"
17E9    6726              gosub 870      ' call umac
17EE    6726    '
17EE    6726              if driver$(50) <> "0" then gosub 2550
1801    6726    '
1801    6726              while cluster1 = cluster(arraynum)
1815    6726    '
1815    6726                   j = chanport(arraynum)
1823    6726    '
1823    6726                   value1$ = driver$(j)
1835    6726                   value1! = val( value1$ )
1843    672A                   if ratio!(arraynum) <> 0 then value1! = value1! * ratio
        !(arraynum) + yoffset!(arraynum): value1$ = str$(value1!): valu
        e1$ = left$(value1$,6)
1895    672A    '
1895    672A    '    Firstflag is equal to 0 the first pass thru the analog var
        iables.
1895    672A    '    This allows initialization of the Rate Of Change.
1895    672A    '
1895    672A                   if firstflag = 0 then value!(arraynum) = value1!
18B2    672A    '
18B2    672A    '    Calculate the deviation of value and determine if out of r
        .o.c. limits.
18B2    672A    '    Store away the new value for future use.
18B2    672A    '
18B2    672A                   valuechng! = abs(value1! - value!(arraynum))
18CC    672E                   value!(arraynum) = value1!
18DE    672E    '
18DE    672E    '    Checker of the limits
18DE    672E    '
18DE    672E                   high1! = highlimit!(arraynum)
18F0    6732                   low1! = lowlimit!(arraynum)
1902    6736    '
1902    6736    '    If already in alarm then deadbands are in effect.
1902    6736    '
1902    6736                   temp = alarmflag(arraynum)
1910    6738    '
1910    6738                   if (temp and lowa) then low1! = low1! + deadband!(array
        num)
1933    6738                   if (temp and higha) then high1! = high1! - deadband!(ar
        raynum)
1958    673A    '
1958    673A    '    Check to see if the variable is back in limits and reset f
        lag if appropriate
1958    673A    '
1958    673A                   if value1! > low1! then temp = (temp and offlowa) else
        temp = (temp or lowa)
197F    673A                   if value1! > lowwlimit!(arraynum) then temp = (temp and
         offloww) else temp = (temp or loww)
19AF    673A    '
```

```
Offset  Data    Source Line          IBM Personal Computer BASIC Compiler V1.00

 19AF   673A                 if value1! < high1! then temp = (temp and offhia) else
                temp = (temp or hia)
 19D6   673A                 if value1! < highwlimit!(arraynum) then temp = (temp an
                d offhiw) else temp = (temp or hiw)
 1A06   673A    '
 1A06   673A                 if valuechng! < roclimit!(arraynum) then temp = (temp a
                nd offroc) else temp = (temp or roc)
 1A36   673A    '
 1A36   673A    '    Store away the state
 1A36   673A    '
 1A36   673A                 alarmflag(arraynum) = temp
 1A45   673A    '
 1A45   673A    '    Increment the arraynum pointer.
 1A45   673A    '
 1A45   673A                 arraynum = arraynum + 1
 1A4D   673A                 if arraynum > numanalog then return
 1A5D   673A    '
 1A5D   673A            wend
 1A61   673A    '
 1A61   673A    '    Update the pointer to the new cluster.
 1A61   673A    '
 1A61   673A            cluster1 = cluster(arraynum)
 1A6F   673A    '
 1A6F   673A        wend
 1A73   673A    '
 1A73   673A        return
 1A76   673A    '
 1A76   673A    5100 '
 1A77   673A    '
 1A77   673A    '    format the value on the screen
 1A77   673A    '
 1A77   673A    '    Pseudo parameters:
 1A77   673A    '
 1A77   673A    '        1) length1 = length of the string.
 1A77   673A    '        2) length2 = maximum length of string
 1A77   673A    '        2) value1$ = string to be converted and put on the sc
                reen.
 1A77   673A    '        3) x = center x coordinate on the screen.
 1A77   673A    '        4) y = y coordinate on the screen.
 1A77   673A    '
 1A77   673A    '    First clean up the area
 1A77   673A    '    If specified
 1A77   673A    '
 1A77   673A        if blank = 0 then 5101
 1A82   673A    '
 1A82   673A        x1 = x - (length2 * 5) / 2
 1AA4   673E        if x1 < 0 then x1 = 0
 1AB6   673E        soff = blankoffset
 1ABD   6740        xdim = length2 * 10
 1AC8   6740        i = peek(xptr)
 1ADB   6740        j = peek(xptr + 1)
 1AEF   6740    '
 1AEF   6740        def seg = storage
 1AF7   6740        poke soff, i
 1B07   6740        poke soff + 1, j
```

```
Offset  Data    Source Line          IBM Personal Computer BASIC Compiler V1.00

1B18    6740        def seg
1B1C    6740    '
1B1C    6740        call place( x1, y, storage, soff)
1B35    6740    '
1B35    6740    5101 '
1B36    6740    '
1B36    6740    '   If blank is not necessary then .......
1B36    6740    '
1B36    6740        x = x - (length1 * 5) / 2
1B58    6740    '
1B58    6740        for vform = 1 to length1
1B65    6742    '
1B65    6742            savasc =  asc( mid$( value1$, vform, 1))
1B79    6746            soff = 0
1B80    6746            if savasc < 123 and savasc > 96 then soff = savasc - 86
1BAA    6746            if savasc < 91 and savasc > 64 then soff = savasc - 54
1BD4    6746            if savasc < 58 and savasc > 47 then soff = savasc - 47
1BFE    6746            if savasc = 43 then soff = 37
1C10    6746            if savasc = 45 then soff = 38
1C22    6746            if savasc = 46 then soff = 39
1C34    6746            if savasc = 32 then soff = 40
1C46    6746            if savasc = 58 then soff = 41
1C58    6746    '
1C58    6746    '   If a non-identifiable character then skip it
1C58    6746    '
1C58    6746            if soff = 0 then goto 5105
1C67    6746    '
1C67    6746            soff = soff * 14 + smalloff
1C76    6746    '
1C76    6746            call place(x, y, storage, soff)
1C8F    6746    '
1C8F    6746    5105 '
1C90    6746    '
1C90    6746            x = x + 5
1C9A    6746    '
1C9A    6746        next vform
1CAE    6746    '
1CAE    6746        return
1CB1    6746    '
1CB1    6746    6000 '
1CB2    6746    '
1CB2    6746    '   Digital handler
1CB2    6746    '
1CB2    6746        arraynum = maxvars
1CB9    6746        currport = chanport(arraynum)
1CC7    6748    '
1CC7    6748    '   Initialize the comm. parameter to Digital in.
1CC7    6748    '
1CC7    6748        driver$(70) = "12"
1CD0    6748    '
1CD0    6748        while arraynum >= digitals
1CDD    6748    '
1CDD    6748            driver$(71) = str$(chanport(arraynum))
1CF0    6748    '
1CF0    6748            gosub 870   ' call umac
```

```
Offset  Data    Source Line          IBM Personal Computer BASIC Compiler V1.00

 1CF5   674B    '
 1CF5   674B            if driver$(50) <> "0" then gosub 2550
 1D08   674B    '
 1D08   674B            din = val(driver$(48))
 1D15   674A    '
 1D15   674A            while currport = chanport(arraynum)
 1D29   674A    '
 1D29   674A                  if (bitmask(bit(arraynum)) and din) then temp = 1 else
                temp = 0
 1D56   674A    '
 1D56   674A    '    Digital mask = 0 if no change, lowm if change
 1D56   674A    '    The change mask will be stored in the alarmflag.
 1D56   674A    '
 1D56   674A                  if temp <> value!(arraynum) then digitalmask = lowm els
                e digitalmask = 0
 1D81   674C                  value!(arraynum) = temp
 1D96   674C    '
 1D96   674C                  if temp = 1 then alarmflag(arraynum) = (hia or digitalm
                ask) else alarmflag(arraynum) = (hiw or digitalmask)
 1DC8   674C    '
 1DC8   674C                  arraynum = arraynum - 1
 1DD0   674C    '
 1DD0   674C            wend
 1DD4   674C    '
 1DD4   674C            currport = chanport(arraynum)
 1DE2   674C    '
 1DE2   674C        wend
 1DE6   674C    '
 1DE6   674C    '    Time variable processor
 1DE6   674C    '
 1DE6   674C        for i = 201 to numtime
 1DF3   6750    '
 1DF3   6750            j = 201 - i
 1DFE   6750            y = elapsed(j)
 1E0C   6750            if alarmflag(i) = roc then y = 0: alarmflag(i) = lowm: goto
                6050
 1E3A   6750            if alarmflag(i) = lowm then y = y + 1: if y = time(j) then a
                larmflag(i) = hia
 1E79   6750    '
 1E79   6750    6050 '
 1E7A   6750    '
 1E7A   6750    '    Label to avoid multiple sets of y updates
 1E7A   6750    '
 1E7A   6750            elapsed(j) = y
 1E89   6750    '
 1E89   6750        next i
 1E9D   6750    '
 1E9D   6750        return
 1EA0   6750    '
 1EA0   6750    6090 '
 1EA1   6750    '
 1EA1   6750    '    Check for the Tab Key
 1EA1   6750    '
 1EA1   6750        keyin = asc(k$)
 1EAB   6752        if keyin = 9 then gosub 12500 else beep
```

```
Offset  Data    Source Line          IBM Personal Computer BASIC Compiler V1.00

 1EC2   6752    '
 1EC2   6752        return
 1EC5   6752    '
 1EC5   6752    6250 '
 1EC6   6752    '
 1EC6   6752    '   Logical groupings handler
 1EC6   6752    '
 1EC6   6752        for r = 0 to numsrecs - 1
 1ED3   6754    '
 1ED3   6754            j = 0     'initialize the row stepper
 1EDA   6754    '
 1EDA   6754            while j < 16
 1EE5   6754    '
 1EE5   6754                if logic(r,j) = 0 then if j > 0 then goto 6253 else got
                o 6263
 1F11   6756    '
 1F11   6756                logicstate = logic(r,j) and statemask
 1F2B   6758                logicentry = logic(r,j) and entrymask
 1F45   675A    '
 1F45   675A                if (alarmflag(logicentry) and logicstate) then j = j +
                1 else goto 6263
 1F6A   675A    '
 1F6A   675A            wend
 1F6E   675A    '
 1F6E   675A    6253 '
 1F6F   675A    '
 1F6F   675A    '   Label to branch for logic being true
 1F6F   675A    '
 1F6F   675A        if logicstat(r) < 2 then logicstat(r) = 2 else logicstat(r
                ) = 4
 1F9D   675A    '
 1F9D   675A    '   Do the actions specified for this logical grouping
 1F9D   675A    '
 1F9D   675A        if alarm(r) > 1 then beep: if logicstat(r) = 2 then type =
                 1: gosub 14000 else if logicstat(r) = 1 then type = 3: gosub 1
                4000
 1FEF   675C        if (logicstat(r) = 4 or logicstat(r) = 0) then goto 6300
 2019   675C    '
 2019   675C        if botscrmessage(r) => 0 then get #4, botscrmessage(r): m$
                 = messagebuf$: locate 23,1: print m$;: lprint date$; time$; m$
                : locate 23,1: print string$(39," ");
 2086   6764        if fullscreen(r) => 0 then get #5, fullscreen(r):ddtfile$
                = nameentry$: gosub 4505: gosub 11100: gosub 3200: close #2: go
                sub 12500: firstflag = 0
 20D3   6768    '
 20D3   6768        if treset(r) => 0 then alarmflag(treset(r)) = hiw
 20F9   6768        if start(r) => 0 then alarmflag(start(r)) = roc
 211F   6768    '
 211F   6768    6300 '
 2120   6768    '
 2120   6768    '   Label for all functions done on true logic
 2120   6768    '
 2120   6768    '   Put the timer reset and timer start check code here
 2120   6768    '   Also the check elapsed time.
 2120   6768    '   Also the screen switch code.
```

```
Offset  Data    Source Line          IBM Personal Computer BASIC Compiler V1.00

2120    676B    '
2120    676B    '    Event history code.
2120    676B    '
2120    676B         if logicstat(r) = 2 then if event(r) > 0 then gosub 14010
2147    676B    '
2147    676B    '    Handle all Digital Outs
2147    676B    '
2147    676B              j = 0
214E    676B              while j < 8
2159    676B    '
2159    676B                   if digitalout(r,j) = 0 then 6264
2172    676B                   logicstate = digitalout(r,j) and statemask
218C    676B                   logicentry = digitalout(r,j) and entrymask
21A6    676B    '
21A6    676B                   if logicstate and hia then dovalue = 1 else dovalue = 0
21C6    676A                   temp = logicentry
21CD    676A                   if value!(temp) <> dovalue then gosub 12000  ' Set the
                digital out
21EC    676A                   j = j + 1
21F4    676A    '
21F4    676A              wend
21F8    676A    '
21F8    676A    '    Skip zero logic code.
21F8    676A    '
21F8    676A              goto 6264
21FC    676A    '
21FC    676A    6263 '
21FD    676A    '
21FD    676A              if logicstat(r) > 1 then logicstat(r) = 1 else logicstat(r)
                = 0
222B    676A    '
222B    676A    6264 '
222C    676A    '
222C    676A    '    Branch label to avoid the negative logic code for logical
                groupings
222C    676A    '
222C    676A         next r
2240    676A    '
2240    676A         return
2243    676A    '
2243    676A    6500 '
2244    676A    '
2244    676A    '    DDT handler
2244    676A    '
2244    676A         on error goto 6520
224B    676A    '
224B    676A         for ddtrecno = 0 to ddtrecs - 1
2258    676C    '
2258    676C              temp = ddtentry(ddtrecno)
2266    676C              if ddttype(ddtrecno) = 1 then gosub 6600 else gosub 6700
2284    676C    '
2284    676C         next
2295    676C    '
2295    676C         firstflag = 1
229C    676C         on error goto 2160
```

```
Offset  Data    Source Line          IBM Personal Computer BASIC Compiler V1.00

 22A3   676C    '
 22A3   676C        return
 22A6   676C    '
 22A6   676C    6520 '
 22A7   676C    '
 22A7   676C    '   Error handler for ddt
 22A7   676C    '
 22A7   676C        locate 23,1
 22B4   676C        print "### Error occurred in DDT processing. ";
 22BC   676C    '
 22BC   676C        resume next
 22C0   676C    '
 22C0   676C    6600 '
 22C1   676C    '
 22C1   676C    '   Screen handler for variables
 22C1   676C    '
 22C1   676C        if temp > numanalog then gosub 6610 else gosub 6620
 22DB   676C    '
 22DB   676C        return
 22DE   676C    '
 22DE   676C    6610 '
 22DF   676C    '
 22DF   676C    '   Digital
 22DF   676C    '
 22DF   676C        if ((alarmflag(temp) and loww) = 0) then if firstflag <> 0
                 then return
 2303   676C    '
 2303   676C        if value!(temp) = 1 then get #5, onestat(temp) else get #5
                , zerostat(temp)
 233F   676C        value1$ = nameentry$
 2348   676C        i = instr(value1$," ")
 2356   676C        if i > 0 then length1 = i else length1 = 8
 2372   676C        length2 = 8
 2379   676C        x = ulxvalue(ddtrecno) + 5
 238A   676C        y = ulyvalue(ddtrecno)
 2398   676C        gosub 5100
 239D   676C    '
 239D   676C        return
 23A0   676C    '
 23A0   676C    6620 '
 23A1   676C    '
 23A1   676C    '   Analog value handler
 23A1   676C    '
 23A1   676C        value1$ = str$(value!(temp))
 23B6   676C        length1 = len(value1$) - 1
 23C1   676C        value1$ = right$(value1$,length1)
 23D2   676C        if length1 > 6 then value1$ = left$(value1$,6): length1 =
                6
 23F4   676C        length2 = 6
 23FB   676C        x = ulxvalue(ddtrecno) - 10
 240C   676C        y = ulyvalue(ddtrecno)
 241A   676C        gosub 5100
 241F   676C    '
 241F   676C    '   Engineering units
 241F   676C    '
```

```
Offset  Data    Source Line          IBM Personal Computer BASIC Compiler V1.00

241F    676C          if firstflag <> 0 then return
242D    676C    '
242D    676C          get #3, engunits(temp)
243E    676C    '
243E    676C          x = x + 16
2448    676C          value1$ = engineeringunits$
2451    6770          length1 = len(value1$)
245B    6770          length2 = 4
2462    6770          gosub 5100
2467    6770    '
2467    6770          return
246A    6770    '
246A    6770    6700 '
246B    6770    '
246B    6770    '     Screen handler for logical groups
246B    6770    '
246B    6770    '     Reset blink counter
246B    6770    '
246B    6770          blink = 0
2472    6772    '
2472    6772          if logicstat(temp) = 0 or alarm(temp) < 1 then 6720
2498    6772    '
2498    6772    '     Poke in the size of the box
2498    6772    '     and the location (x,y) on the screen
2498    6772    '
2498    6772          def seg = storage
24A0    6772          poke redoffset, sizex(ddtrecno)
24B7    6772          poke redoffset + 2, sizey(ddtrecno)
24D0    6772          def seg
24D4    6772    '
24D4    6772          x = ulxchar(ddtrecno)
24E2    6772          y = ulychar(ddtrecno)
24F0    6772    '
24F0    6772          if logicstat(temp) = 1 then blink = 1
2508    6772          if logicstat(temp) = 2 then blink = 3
2520    6772          if logicstat(temp) = 4 then blink = 2
2538    6772    '
2538    6772          if blink > 0 then call overlay(x, y, storage, redoffset):
                blink = blink - 1
2564    6772    '
2564    6772    6720 '
2565    6772    '
2565    6772    '     Put up the message
2565    6772    '
2565    6772          if firstflag <> 0 then 6900
2570    6772          if scrmessage(temp) > 0 then get #4, scrmessage(temp) else
                 return
2598    6772          value1$ = messagebuf$
25A1    6772          length1 = instr(value1$,"  ") - 1
25B0    6772          if length1 = 0 then length1 = len(value1$)
25C5    6772          length2 = 39
25CC    6772          x = ulxvalue(ddtrecno)
25DA    6772          y = ulyvalue(ddtrecno)
25E8    6772          gosub 5100
25ED    6772    '
```

```
Offset  Data    Source Line          IBM Personal Computer BASIC Compiler V1.00

25ED    6772    6900 '
25EE    6772    '
25EE    6772    '    Label to skip screen message play.
25EE    6772    '
25EE    6772         if blink < 1 then return
25FC    6772    '
25FC    6772         x = ulxchar(ddtrecno)
260A    6772         y = ulychar(ddtrecno)
2618    6772    '
2618    6772         for i = 1 to blink
2625    6774             call overlay(x, y, storage, redoffset)
263E    6774         next i
264F    6774    '
264F    6774         return
2652    6774    '
2652    6774
2652    6774    7000 '
2653    6774    '
2653    6774    '    Check key input
2653    6774    '
2653    6774         k$ = right$(k$,1)
2663    6774         keyin = asc(k$)
266D    6774         if keyin > 58 and keyin < 69 then keyin = keyin - 58 else
                beep: return
26A1    6774    '
26A1    6774         on keyin gosub 8000, 8000, 32767, 8000, 8000, 8000, 8000,
                8000, 8000, 11900
26BD    6774    '
26BD    6774    '                                   end
                         dout
26BD    6774    '
26BD    6774         return
26C0    6774    '
26C0    6774    8000 '
26C1    6774    '
26C1    6774    '   Bad key entry
26C1    6774    '
26C1    6774         beep
26C5    6774    '
26C5    6774         return
26C8    6774    '
26C8    6774    9000 '
26C9    6774    '
26C9    6774    '    communications switcher
26C9    6774    '
26C9    6774         comswitch = 1
26D0    6774         return
26D3    6774    '
26D3    6774    10000 '
26D4    6774    '
26D4    6774    '    file in process
26D4    6774    '
26D4    6774    '    init bit masks for di do
26D4    6774    '
26D4    6774         for i = 0 to 7
```

```
Offset  Data    Source Line          IBM Personal Computer BASIC Compiler V1.00

26D8    6774            bitmask(i) = 2^i
26F3    6774        next i
2702    6774    '
2702    6774    '   get the number of records in the variable file from the he
                ader.
2702    6774    '
2702    6774        on error goto 4000 ' error handler
2709    6774    '
2709    6774        ddt$ = "VARFILE.TAB"
2712    6774    '
2712    6774        open ddt$ as #1 len = 64
2725    6774        if nofilefl = 1 then 32767
2730    6774    '
2730    6774        ddt$ = "File has been opened"
2739    6774    '
2739    6774        field #1, 2 as senseup$, 62 as fill$
274F    6774        get #1,1
2759    6774    '
2759    6774        varrecs = cvi(senseup$)
2764    6776    '
2764    6776    '   Get the variable file entries and break them into their re
                spective classes
2764    6776    '   ie. Analog  and  Digital
2764    6776    '   Default is digital( more digital points than analog )
2764    6776    '
2764    6776    '
2764    6776        for recno = 2 to varrecs + 1
2772    6778    '
2772    6778            field #1, 2 as senseup$, 8 as varup$, 2 as clusterup$, 2 as e
                t$,2 as portup$, 2 as bitup$, 2 as zerosup$, 2 as onesup$, 42 a
                s fillup$
27C0    677C            get #1, recno
27CB    677E            t = cvi(senseup$)
27D6    6780            if t = 1 then gosub 3000 else if t = 4 then gosub 3150 else g
                osub 3100
2801    6780    '
2801    6780        next recno
2815    6780    '
2815    6780        numdigital = drecnum - 1
281D    6782        digitals = maxvars - numdigital
2828    6782    '
2828    6782        numanalog = arecnum - 1
2830    6782        numtime = timerec - 1
2838    6782    '
2838    6782        close #1   ' variable file
283F    6782    '
283F    6782    '   Get the Action screen entries in.
283F    6782    '
283F    6782        gosub 20000
2844    6782    '
2844    6782    '   Get the DDT and update DDTENTRY file
2844    6782    '
2844    6782        gosub 11100    'first record(count)
2849    6782    '
2849    6782        gosub 3200     'read the ddt records in.
284E    6782    '
```

```
Offset  Data    Source Line          IBM Personal Computer BASIC Compiler V1.00

284E    6782         close #2   ' DDt file
2855    6782    '
2855    6782    '    return to umac error handler
2855    6782    '
2855    6782         on error goto 2160
285C    6782    '
285C    6782         return
285F    6782    '
285F    6782    11100 '
2860    6782    '
2860    6782    '    DDT initialization process
2860    6782    '
2860    6782    '
2860    6782    '    initialize the ddt entry table
2860    6782    '
2860    6782         for i = 0 to maxvars
286C    6784              ddtentry(i) = 0
2879    6784         next i
288A    6784    '
288A    6784    '    get the number of entries in the ddt table
288A    6784    '
288A    6784         ddt$ = ddtfile$ + ".ddt"
2898    6784         open ddt$ as #2 len = 20
28AB    6784         field #2, 2 as entry$, 2 as ulxchar$, 2 as ulychar$, 2 as
                boxx$, 2 as boxy$, 2 as alarm$, 2 as ulxvalue$, 2 as ulyvalue$,
                 2 as typeddt$, 2 as fill$
2901    6788    '
2901    6788         get #2,1
290B    6788         ddtrecs = cvi(entry$)
2916    6788    '
2916    6788         return
2919    6788    '
2919    6788    11900 '
291A    6788    '
291A    6788    '    F10 change digital out state.
291A    6788    '
291A    6788         if digouts = 0 then return
2928    6788         temp = ddtentry(tabflag)
2936    6788         i = value!(temp)
2949    6788         if i > 0 then dovalue = 0 else dovalue = 1
2965    6788    '
2965    6788         gosub 12000 'swap the do
296A    6788    '
296A    6788         return
296D    6788    '
296D    6788    12000 '
296E    6788    '
296E    6788    '    Change state of DO
296E    6788    '
296E    6788    '    dovalue = the new state for the digital out.
296E    6788    '    temp = arraynum pointer for variable addressing informatio
                n
296E    6788    '
296E    6788         if dovalue = 0 then driver$(70) = "9" else driver$(70) = "
                8"
298E    6788    '
```

```
Offset  Data    Source Line          IBM Personal Computer BASIC Compiler V1.00

 29BE   678B        driver$(71) = str$(chanport(temp))
 29A1   678B        driver$(72) = str$(bit(temp))
 29B4   678B    '
 29B4   678B        gosub 870 ' invoke umac
 29B9   678B    '
 29B9   678B        if driver$(50) <> "0" then gosub 2550
 29CC   678B    '
 29CC   678B        return
 29CF   678B    '
 29CF   678B    12500 '
 29D0   678B    '
 29D0   678B    '   Tab key pressed so, find next DO and reverse-video it.
 29D0   678B    '   If no Digital outs, then digouts = 0
 29D0   678B    '
 29D0   678B        if digouts = 0 then return
 29DE   678B    '
 29DE   678B    '   Reset the old tab area and reverse the new.
 29DE   678B    '
 29DE   678B        flag = 0
 29E5   678A        if firsttab <> 0 then gosub 12510
 29F5   678A    '
 29F5   678A        tabflag = tabflag + 1
 29FD   678A        if tabflag > ddtrecs - 1 then tabflag = 0
 2A13   678A        checks = 1
 2A1A   678C        flag = 2
 2A21   678C        while  checks
 2A2D   678C    '
 2A2D   678C            for ddtrecno = tabflag to ddtrecs - 1
 2A3B   678E    '
 2A3B   678E                temp = ddtentry(ddtrecno)
 2A49   678E                if ddttype(ddtrecno) <> 1 or sensor(temp) <> 2 then 125
                02
 2A75   678E                tabflag = ddtrecno
 2A7C   678E                gosub 12510
 2A81   678E                firsttab = 1
 2A88   678E                return
 2A8B   678E    12502 '
 2A8C   678E    '
 2A8C   678E    '   If not the right type then onward ho.......
 2A8C   678E    '
 2A8C   678E            next
 2A9D   678E    '
 2A9D   678E            if firsttab = 0 then checks = 0 else tabflag = 0
 2AB9   678E    '
 2AB9   678E        wend
 2ABD   678E    '
 2ABD   678E    12505 '
 2ABE   678E    '
 2ABE   678E    '   Skip the no DO flag.
 2ABE   678E    '
 2ABE   678E        return
 2AC1   678E    '
 2AC1   678E    12510 '
 2AC2   678E    '
 2AC2   678E    '   Underline the value area.
```

```
Offset  Data    Source Line        IBM Personal Computer BASIC Compiler V1.00

 2AC2   678E    '
 2AC2   678E        x = ulxvalue(tabflag)
 2AD0   678E        y = ulyvalue(tabflag)
 2ADE   678E    '
 2ADE   678E        x = x - 13
 2AE8   678E        x1 = x + 32
 2AF2   678E        y = y + 7
 2AFC   678E        y1 = y
 2B03   6790    '
 2B03   6790    '   Use a flag = 2 to mean put a line
 2B03   6790    '   Use a flag = 0 to mean erase line
 2B03   6790    '
 2B03   6790        line (x,y) - (x1,y1), flag
 2B1E   6790    '
 2B1E   6790        return
 2B21   6790    '
 2B21   6790    13000 '
 2B22   6790    '
 2B22   6790    '   Open the engineering units and message files
 2B22   6790    '                  3                  4
 2B22   6790    '
 2B22   6790        ddt$ = "engunit.tab"
 2B2B   6790        open ddt$ as #3 len = 4
 2B3E   6790        field #3, 4 as engineeringunits$
 2B4C   6790    '
 2B4C   6790        ddt$ = "message.tab"
 2B55   6790        open ddt$ as #4 len = 40
 2B68   6790        field #4, 39 as messagebuf$, 1 as fill$
 2B7E   6790    '
 2B7E   6790        ddt$ = "names.tab"
 2B87   6790        open ddt$ as #5 len = 10
 2B9A   6790        field #5, 8 as nameentry$, 2 as nametype$
 2BB0   6794    '
 2BB0   6794        ddt$ = "event.tab"
 2BB9   6794        open ddt$ as #6 len = 14
 2BCC   6794        field #6, 2 as actent$, 12 as actdate$
 2BE2   679C        get #6, 1
 2BEC   679C        evententry = cvi(actent$)
 2BF7   679E    '
 2BF7   679E        ddt$ = "alarm.tab"
 2C00   679E        open ddt$ as #7 len = 16
 2C13   679E        field #7, 2 as alarment$, 2 as typealarm$, 12 as alarmdate
                $
 2C31   67AA        get #7, 1
 2C3B   67AA        alarmentry = cvi(alarment$)
 2C46   67AC    '
 2C46   67AC        return
 2C49   67AC    '
 2C49   67AC    14000 '
 2C4A   67AC    '
 2C4A   67AC    '   Write a record to the alarm file
 2C4A   67AC    '
 2C4A   67AC    '   type =
 2C4A   67AC    '
 2C4A   67AC    '        1 = alarm occurred
```

```
Offset  Data    Source Line          IBM Personal Computer BASIC Compiler V1.00

2C4A    67AC    '          2 = alarm acknowledged
2C4A    67AC    '          3 = out of alarm
2C4A    67AC    '
2C4A    67AC    '    User defined maximum alarmentries
2C4A    67AC    '
2C4A    67AC         alarmentry = alarmentry + 1
2C52    67AC         if alarmentry > 200 then alarmentry = 2
2C65    67AC         if alarmentry < 2 then alarmentry = 2
2C77    67AC    '
2C77    67AC         datetime$ = left$(date$,2) + mid$(date$,4,2) + mid$(date$,
                9,2) + left$(time$,2) + mid$(time$,4,2) + mid$(time$,7,2)
2CD1    67B0    '
2CD1    67B0         lset typealarm$ = mki$(type)
2CDE    67B0         lset alarment$ = mki$(lentry(r))
2CF1    67B0         lset alarmdate$ =  datetime$
2CFA    67B0    '
2CFA    67B0         put #7, alarmentry
2D05    67B0    '
2D05    67B0         return
2D08    67B0    '
2D08    67B0    14010 '
2D09    67B0    '
2D09    67B0    '    Write a record to the event file
2D09    67B0    '
2D09    67B0         evententry = evententry + 1
2D11    67B0         if evententry > 200 then evententry = 2
2D24    67B0         if evententry < 2 then evententry-= 2
2D36    67B0    '
2D36    67B0         datetime$ = left$(date$,2) + mid$(date$,4,2) + mid$(date$,
                9,2) + left$(time$,2) + mid$(time$,4,2) + mid$(time$,7,2)
2D90    67B0    '
2D90    67B0         lset actent$ = mki$(lentry(r))
2DA3    67B0         lset actdate$ = datetime$
2DAC    67B0    '
2DAC    67B0         put #6, evententry
2DB7    67B0    '
2DB7    67B0         return
2DBA    67B0    '
2DBA    67B0    20000 '
2DBB    67B0    '
2DBB    67B0    '    Get the Action Screen entries in.
2DBB    67B0    '
2DBB    67B0         ddt$ = "SCRFILE.TAB"
2DC4    67B0         open ddt$ as #2 len = 72
2DD7    67B0    '
2DD7    67B0         field #2, 2 as name$, 68 as fill$
2DED    67B4         get #2,1
2DF7    67B4         numsrecs = cvi( name$ )
2E02    67B4    '
2E02    67B4    field 2,2as a$,8as b$,2as c$,2as d$,2as e$,2as f$,2as g$,2as h$
                ,2as i$,2as j$,2as k$,2as l$,2as m$,2as n$,2as o$,2as p$,2as q$
                ,2as r$,2as s$,2as t$,2as u$,2as v$,2as w$,2as x$,2as y$,2as z$
                ,2as a0$,2as a1$,2as a2$,2as a3$,2as a4$,2as a5$,2as a6$
2F10    6B2C    '
2F10    6B2C    '
```

```
Offset  Data    Source Line        IBM Personal Computer BASIC Compiler V1.00

2F10    682C        for i = 0 to numsrecs - 1
2F1D    682E    '
2F1D    682E            get #2, i + 2
2F2A    682E    '
2F2A    682E    '   Get in the logical status's
2F2A    682E    '
2F2A    682E            j = 0
2F31    682E    '
2F31    682E            while j < 15
2F3C    682E    '
2F3C    682E                gosub 20010
2F41    682E                logic(i, j) = temp
2F58    682E                j = j + 1
2F60    682E    '
2F60    682E            wend
2F64    682E    '
2F64    682E            lentry(i) = cvi(a$)
2F75    682E            scrmessage(i) = cvi(r$)
2F86    682E            botscrmessage(i) = cvi(s$)
2F97    682E            fullscreen(i) = cvi(t$)
2FA8    682E            event(i) = cvi(u$)
2FB9    682E            alarm(i) = cvi(v$)
2FCA    682E            audible(i) = cvi(w$)
2FDB    682E    '
2FDB    682E            temp = cvi(x$)
2FE6    682E            if temp > 0 then gosub 20030
2FF6    682E            treset(i) = temp
3005    682E    '
3005    682E            temp = cvi(y$)
3010    682E            if temp > 0 then gosub 20030
3020    682E            start(i) = temp
302F    682E    '
302F    682E            j = 0
3036    682E            while j < 8
3041    682E    '
3041    682E                gosub 20020
3046    682E                digitalout(i, j) = temp
305D    682E                j = j + 1
3065    682E    '
3065    682E            wend
3069    682E    '
3069    682E        next i
307D    682E    '
307D    682E        close #2
3084    682E    '
3084    682E        return
3087    682E    '
3087    682E    20010 '
3088    682E    '
3088    682E    '   Set temp appropriately.
3088    682E    '   For reading in file.
3088    682E    '
3088    682E        if j = 0 then temp = cvi(c$)
309E    682E        if j = 1 then temp = cvi(d$)
30B4    682E        if j = 2 then temp = cvi(e$)
```

```
Offset  Data    Source Line        IBM Personal Computer BASIC Compiler V1.00

30CA    682E        if j = 3 then temp = cvi(f$)
30E0    682E        if j = 4 then temp = cvi(g$)
30F6    682E        if j = 5 then temp = cvi(h$)
310C    682E        if j = 6 then temp = cvi(i$)
3122    682E        if j = 7 then temp = cvi(j$)
3138    682E        if j = 8 then temp = cvi(k$)
314E    682E        if j = 9 then temp = cvi(l$)
3164    682E        if j = 10 then temp = cvi(m$)
317A    682E        if j = 11 then temp = cvi(n$)
3190    682E        if j = 12 then temp = cvi(o$)
31A6    682E        if j = 13 then temp = cvi(p$)
31BC    682E        if j = 14 then temp = cvi(q$)
31D2    682E    '
31D2    682E        if temp <> 0 then gosub 20030 else j = 15
31EC    682E    '
31EC    682E        return
31EF    682E    '
31EF    682E    20020 '
31F0    682E    '
31F0    682E    '   Set temp appropriately.
31F0    682E    '   For reading in file.
31F0    682E    '
31F0    682E        if j = 0 then temp = cvi(z$)
3206    682E        if j = 1 then temp = cvi(a0$)
321C    682E        if j = 2 then temp = cvi(a1$)
3232    682E        if j = 3 then temp = cvi(a2$)
3248    682E        if j = 4 then temp = cvi(a3$)
325E    682E        if j = 5 then temp = cvi(a4$)
3274    682E        if j = 6 then temp = cvi(a5$)
328A    682E        if j = 7 then temp = cvi(a6$)
32A0    682E    '
32A0    682E        if temp <> 0 then gosub 20030 else j = 8
32BA    682E    '
32BA    682E        return
32BD    682E    '
32BD    682E    20030 '
32BE    682E    '
32BE    682E    '   Swap arraynum for variable entry
32BE    682E    '
32BE    682E    '   F E D C   B A 9 8   7 6 5 4   3 2 1 0
32BE    682E    '
32BE    682E    '
32BE    682E        t1 = temp and entrymask
32C9    6830    '
32C9    6830        for r = 0 to numanalog
32D5    6832            if t1 = varentry(r) then goto 20035
32ED    6832        next
32FE    6832    '
32FE    6832        for r = digitals to maxvars
330B    6834            if t1 = varentry(r) then goto 20035
3323    6834        next
3334    6834    '
3334    6834        for r = 201 to numtime
3341    6836            if t1 = varentry(r) then goto 20035
3359    6836        next r
```

```
Offset  Data    Source Line          IBM Personal Computer BASIC Compiler V1.00

336A    6836    '
336A    6836        gosub 2400
336F    6836    '
336F    6836        locate 23,1
337C    6836        print "No entry found for the Logical Group";
3384    6836    '
3384    6836        return
3387    6836    '
3387    6836    20035 '
3388    6836    '
3388    6836    '   Set temp = arraynum
3388    6836    '   Or the flag in
3388    6836    '
3388    6836        t1 = temp and statemask
3393    6836        t1 = t1 or r
339E    6836    '
339E    6836        temp = t1
33A5    6836    '
33A5    6836        return
33A8    6836    '
33A8    6836    29999 '
33A9    6836    '
33A9    6836    '   Get the name of the display.
33A9    6836    '
33A9    6836        ddtfile$ = ""
33B2    6836        def seg = 0
33BB    6836        storage = peek(&h3fe) + 256 * peek(&h3ff)
33EB    6836    '
33EB    6836        for i = 6 to 13
33F2    6836    '
33F2    6836            def seg = storage
33FA    6836            temp = peek(i)
340D    6836            a$ = chr$(temp)
341A    6836            ddtfile$ = ddtfile$ + a$
3426    6836            def seg
342A    6836    '
342A    6836        next
3439    6836    '
3439    6836        return
343C    6836    '
343C    6836    32767 '
343D    6836    '
343D    6836    '   The end
343D    6836    '
343D    6836        close #3
3444    6836        close #4
344B    6836        close #5
3452    6836        close #6
3459    6836        close #7
3460    6836    '
```

```
Offset  Data    Source Line        IBM Personal Computer BASIC Compiler V1.00

 3460   6836          run "Engineer.exe"
 3467   6836    '
 3467   6836          end
 346B   6836
 46F0   6836

22151 Bytes Available
 6024 Bytes Free

    0 Warning Error(s)
    0 Severe  Error(s)
```

I claim:

1. A display system for a monitoring and alarm system, said monitoring and alarm system including a central processing unit, a plurality of sensors polled by said central processing unit to provide output signals representative of sensed variables to said central processing unit, display means for receiving user inputs to group a plurality of said sensed variables and the states and limits of each of the variables in a group, each group having at least one variable, means controlled by said central processing unit in response to all the conditions defined by the states and limits of variables in a group being true for generating alarms and messages, said display system comprising:

means for interactively generating on said display means a schematic display of the system or environment being monitored, and means for dynamically linking alarm areas on the schematic display with a group or single variable defined by the user.

2. The display system recited in claim 1 further comprising means for dynamically linking message areas on the schematic display with user defined messages to be displayed in the event all the conditions defined by the states and limits of variables in a group are true.

3. The display system recited in claim 2 further comprising means in said central processing unit for storing each schematic display generated together with data defining the linked areas of the display.

4. The display system recited in claim 3 further comprising means for invoking a schematic display stored in said central processing unit, said display means then displaying messages and status conditions on said schematic display in response to the sensed conditions of groups of variables sensed by said monitoring and alarm system.

5. A method of providing a display for a monitoring and alarm system comprising the steps of interactively generating on a computer screen a schematic display of the system or environment being monitored, dynamically linking alarm areas on the schematic display with a group or single variable defined by the user, dynamically linking message areas on the schematic display with user defined messages to be displayed in the event all the conditions defined by the states and limits of variables in a group are true, and storing in computer memory each schematic display generated together with the data defining the linked areas of the display.

6. The method according to claim 5 wherein the step of dynamically linking alarm areas comprises the steps of selecting an option to associate an area on the computer screen with an alarm, pointing to starting coordinates of said area, and drawing a geometrical figure around said area beginning at said starting coordinates.

7. The method according to claim 6 wherein the step of dynamically linking message areas comprises the steps of entering a variable or an alarm/action name, and pointing to the value area on the computer screen for the named variable or alarm/action.

8. The method according to claim 5 wherein the step of storing comprises the steps of creating a first file for saving the interactively generated schematic display, and creating a second file for saving the dynamically linked display information, said second file containing a first record specifying how many records are in the file and a plurality of records containing the linking information.

9. The method according to claim 8 further comprising the steps of invoking a stored schematic display, and displaying messages and status conditions on said schematic display in response to the sensed conditions of groups of variables sensed by said monitoring and alarm system.

10. The method according to claim 9 wherein the step of invoking comprises the steps of creating a data base of variables, alarm/action entries and dynamic display entries from said first and second files, and acquiring data of the sensed variables and checking the logical groups, if any, of the variables.

* * * * *